US011614297B2

(12) United States Patent
Wheeler et al.

(10) Patent No.: US 11,614,297 B2
(45) **Date of Patent: *Mar. 28, 2023**

(54) GAS BLOCK AND BARREL ASSEMBLY AND METHOD OF FABRICATING SAME

(71) Applicant: Maxim Defense Industries, LLC, St. Cloud, MN (US)

(72) Inventors: Joseph Wheeler, Bruneau, ID (US); Jacob Kunsky, Bruneau, ID (US); Grey Oliver Beaudry, Bruneau, ID (US); Travis Bundy, St. Cloud, MN (US); Jason Harper, Meridian, ID (US); Michael G. Windfeldt, St. Augusta, MN (US)

(73) Assignee: Maxim Defense Industries, LLC, St. Cloud, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/165,784

(22) Filed: Feb. 2, 2021

(65) Prior Publication Data

US 2021/0333060 A1 Oct. 28, 2021

Related U.S. Application Data

(63) Continuation of application No. 16/747,478, filed on Jan. 20, 2020, now Pat. No. 11,041,687, which is a continuation-in-part of application No. 16/689,037, filed on Nov. 19, 2019, and a continuation-in-part of application No. 29/676,356, filed on Jan. 10, 2019, now Pat. No. Des. 953,470.

(60) Provisional application No. 62/885,146, filed on Aug. 9, 2019, provisional application No. 62/797,923, filed on Jan. 28, 2019, provisional application No. 62/777,739, filed on Dec. 10, 2018.

(51) Int. Cl.

| | |
|---|---|
| ***F41A 5/18*** | (2006.01) |
| ***F41A 5/28*** | (2006.01) |
| ***F41A 21/28*** | (2006.01) |

(52) U.S. Cl.

CPC ..... *F41A 21/28* (2013.01); *F41A 5/18* (2013.01); *F41A 5/28* (2013.01)

(58) Field of Classification Search

CPC ..... F41A 5/18; F41A 5/26; F41A 5/28; F41A 21/28

See application file for complete search history.

(56) References Cited

U.S. PATENT DOCUMENTS 1,387,889 A * 8/1921 Johnston ..... F41A 5/26 89/193
2,865,256 A * 12/1958 Marsh ..... F41A 3/62 89/191.01

(Continued)

*Primary Examiner* — Gabriel J. Klein
(74) *Attorney, Agent, or Firm* — Law Office of Arthur M. Antonelli, PLLC

(57) ABSTRACT

A regulated gas block assembly may include a gas block including a barrel receiving bore, a gas tube receiving bore, and an intermediate passage extending from the barrel receiving bore to the gas tube receiving bore. The intermediate passage may be oriented at an oblique angle with respect to the barrel receiving bore. The intermediate passage may include a gas regulator seat, and a gas regulator may be positioned and removably secured in the gas regulator seat. A barrel including a gas ring recess may be fit to the regulated gas block assembly.

20 Claims, 25 Drawing Sheets

26(56) References Cited

U.S. PATENT DOCUMENTS

| | | | | | |
|---|---|---|---|---|---|
| 2,872,851 | A * | 2/1959 | Katz | F41A 5/28 | 89/193 |
| 3,333,509 | A * | 8/1967 | Muhlemann | F41A 5/28 | 89/193 |
| 3,893,370 | A * | 7/1975 | Hutton | F41A 5/26 | 89/193 |
| 4,178,832 | A * | 12/1979 | Crowell | F41A 5/18 | 89/193 |
| 5,247,758 | A * | 9/1993 | Mason | F41A 11/00 | 42/75.02 |
| 5,945,626 | A * | 8/1999 | Robbins | F41A 5/26 | 89/193 |
| 8,250,964 | B2 * | 8/2012 | Stone | F41A 5/26 | 89/193 |
| 2013/0025445 | A1 * | 1/2013 | Windauer | F41A 5/28 | 89/193 |
| 2016/0178299 | A1 * | 6/2016 | Cassels | F41A 5/28 | 89/193 |
| 2020/0278165 | A1 * | 9/2020 | Wheeler | F41A 21/28 | |
| 2021/0389066 | A1 * | 12/2021 | Sylvester | F41A 5/26 | |
| 2022/0057152 | A1 * | 2/2022 | Leitner-Wise | F41A 5/28 | |

* cited by examiner

GAS BLOCK AND BARREL ASSEMBLY AND METHOD OF FABRICATING SAME

CROSS REFERENCE TO RELATED APPLICATIONS

This application is a continuation of U.S. patent application Ser. No. 16/747,478 filed Jan. 20, 2020 (the '478 application). The '478 application claims the benefit of U.S. Provisional Application No. 62/797,923 filed Jan. 28, 2019. Additionally, the '478 application claims the benefit of U.S. Provisional Application No. 62/885,146 filed Aug. 9, 2019. The '478 application is a continuation-in-part of U.S. patent application Ser. No. 29/676,356 filed Jan. 10, 2019. Also, the '478 application is a continuation-in-part of U.S. patent application Ser. No. 16/689,037 filed Nov. 19, 2019, which claims the benefit of U.S. Provisional Application No. 62/777,739 filed Dec. 10, 2018. The entire disclosure of each of the U.S. Patent applications mentioned in this paragraph is incorporated by reference herein.

FIELD OF THE INVENTION

The invention generally relates to firearms. More particularly, the invention relates to a gas block and barrel assembly for regulating gas flow to an autoloading firearm operating system.

BACKGROUND

Firearms may be operated by energy that is released from the firing of an ammunition cartridge. More particularly, detonation of propellant within an ammunition cartridge may release energy that is transformed into mechanical work to induce a firearm's cycle of operation (feeding, chambering, locking, firing, unlocking, extracting, ejecting, cocking). For instance, a gas system for an autoloading rifle may include a pressure impulse-based system which is driven by a gas port. The gas port may be connected via a gas tube to a bolt carrier group. After the unlocking phase of the cycle of operation, the gas tube interface to the bolt carrier group may begin to move in the direction of extraction, and the interface between the gas tube and the bolt carrier may separate. At this point, energy transferred from pressurized exhaust gases within the gas system may be transformed into potential energy within an energy storage system, such as a buffer spring. Potential energy stored in the buffer spring then may be released to initiate another cycle of operation. The amount of energy that is transferred to the projectile and the stored energy that is available for inducing another cycle of operation may affect firearm operation. Accordingly, a need exists for systems and methods which may efficiently utilize energy released during a firearm's cycle of operation.

SUMMARY

Hence, the present invention is generally directed toward a gas block assembly for regulating gas flow to an autoloading firearm operating system. The gas block assembly may include a gas block for collecting discharge gases from a barrel. The gas block may include a first side, a second side spaced from the first side, and a barrel receiving bore extending from the first side to the second side. The barrel receiving bore may include a first longitudinal axis. The gas block further may include a gas tube receiving bore extending from the first side to the second side. The gas tube receiving bore may include a second longitudinal axis, the second longitudinal axis being in substantially parallel alignment with the first longitudinal axis. Also, the gas block may include an intermediate passage extending from the barrel receiving bore to the gas tube receiving bore.

The intermediate passage may include a third longitudinal axis, the third longitudinal axis and the first longitudinal axis defining an oblique angle. The intermediate passage may include a starting gas hole segment adjacent the barrel receiving bore and an exiting gas hole segment adjacent the gas tube receiving bore. The exiting gas hole segment may include a first cross-section perpendicular to the third longitudinal axis. The first cross-section may have a first diameter. The intermediate passage further may include a gas regulator seat between the starting gas hole and the exiting gas hole. The gas regulator seat may include a second cross-section perpendicular to the third longitudinal axis. The second cross-section may have a second diameter. The second diameter may be greater than the first diameter.

The gas block assembly further may include a gas regulator arranged in the gas regulator seat. The gas regulator may include a plug including a fourth longitudinal axis. The plug may include a first end and a second end spaced from the first end along the fourth longitudinal axis. Also, the plug may include a gas regulating hole extending from the first end to the second end. The gas regulating hole may include a nozzle segment facing the starting gas hole segment, a keyed segment facing the exiting gas hole segment, and an intermediate segment. The intermediate segment may be disposed between the nozzle segment and the keyed segment. The intermediate segment may be in fluid communication with the starting gas hole segment and the exiting gas hole segment.

Additionally, the plug further may include an exterior surface between the first end and the second end such that the exterior surface is configured and dimensioned to interlock with the gas regulator seat. The gas regulator seat further may include a first screw thread, and the exterior surface may include a second screw thread. The second screw thread may be configured and dimensioned to mate with the first screw thread. Moreover, the first screw thread and the second screw thread may be interlocked, blocking fluid flow between the exterior surface and the regulator seat. The gas regulating hole may fluidly connect the starting gas hole segment and the exiting gas hole segment. Also, the keyed segment may include a drive slot for rotating the gas regulator with respect to the gas regulator seat. The drive slot may further include a third cross-section perpendicular to the fourth longitudinal axis, the third cross-section having a hexagonal shape.

The intermediate segment may include a fourth cross-section perpendicular to the fourth longitudinal axis. The fourth cross-section may include a first maximum outer dimension, and the starting gas hole segment may include a fifth cross-section perpendicular to the third longitudinal axis. The fifth cross-section may include a second maximum outer dimension. The second outer maximum dimension may be greater than the fourth maximum outer dimension. Additionally, the oblique angle may range from approximately 30 degrees to approximately 90 degrees. More particularly, the oblique angle may be approximately 50 degrees.

Further still, the barrel receiving bore may be configured and dimensioned to form a slip fit with a barrel. Also, the gas block may include an orientation key. The gas block further may include an access portal proximate to the gas receiving tube, the access portal providing access to the exiting gas hole such that a drive tool may be connected to the keyed segment and arranged through the access portal and the gas tube receiving bore.

Another aspect of the present invention is directed to a regulated gas block and barrel assembly. The regulated gas block and barrel assembly may include a gas block assembly as described herein and a barrel fitted in the barrel receiving bore. The barrel further may include a first gas port. The first gas port may be in fluid communication with the starting gas hole segment. Also, the barrel further may include a gas ring recess. The gas ring recess may be in fluid communication with the starting gas hole segment. The gas ring recess may include a circumferential groove around the barrel. Additionally, the barrel further may include a plurality of gas ports other than the first gas port. The plurality of gas ports may be in fluid communication with the circumferential groove.

Another aspect of the present invention is directed to a method of fabricating a regulated gas block assembly for a firearm. The method may include orienting a blank of material for fabricating a regulated gas block, advancing a barrel receiving bore through the blank, and advancing a gas tube receiving bore through the blank. The method further may include establishing a longitudinal axis extending from the barrel receiving bore to the gas tube bore, and advancing a first bore including a first diameter through the blank from the barrel receiving bore along the longitudinal axis to the gas tube receiving bore to create an intermediate passage such that the intermediate passage defines an exiting gas hole. Moreover, the method may include creating a second bore including a second diameter, the second diameter being greater than the first diameter, the second bore extending from the barrel receiving bore along the longitudinal axis to define an intermediate segment of the intermediate passage such that the second bore defines a seat for a gas regulator. The method may include advancing a third bore including a third outer dimension greater than the second diameter along the longitudinal axis from the barrel receiving bore to the intermediate segment such that the third bore defines an entering gas hole. Also, the method may include removing material from an exterior surface of the blank to create an access portal connecting the exterior surface of the blank to the exiting gas hole, as well as positioning a gas regulator into the seat.

DESCRIPTION OF THE DRAWINGS

In the accompanying drawings, which form part of this specification and are to be read in conjunction therewith and in which like reference numerals are used to indicate like parts in the various views.

DESCRIPTION

Figure 1:
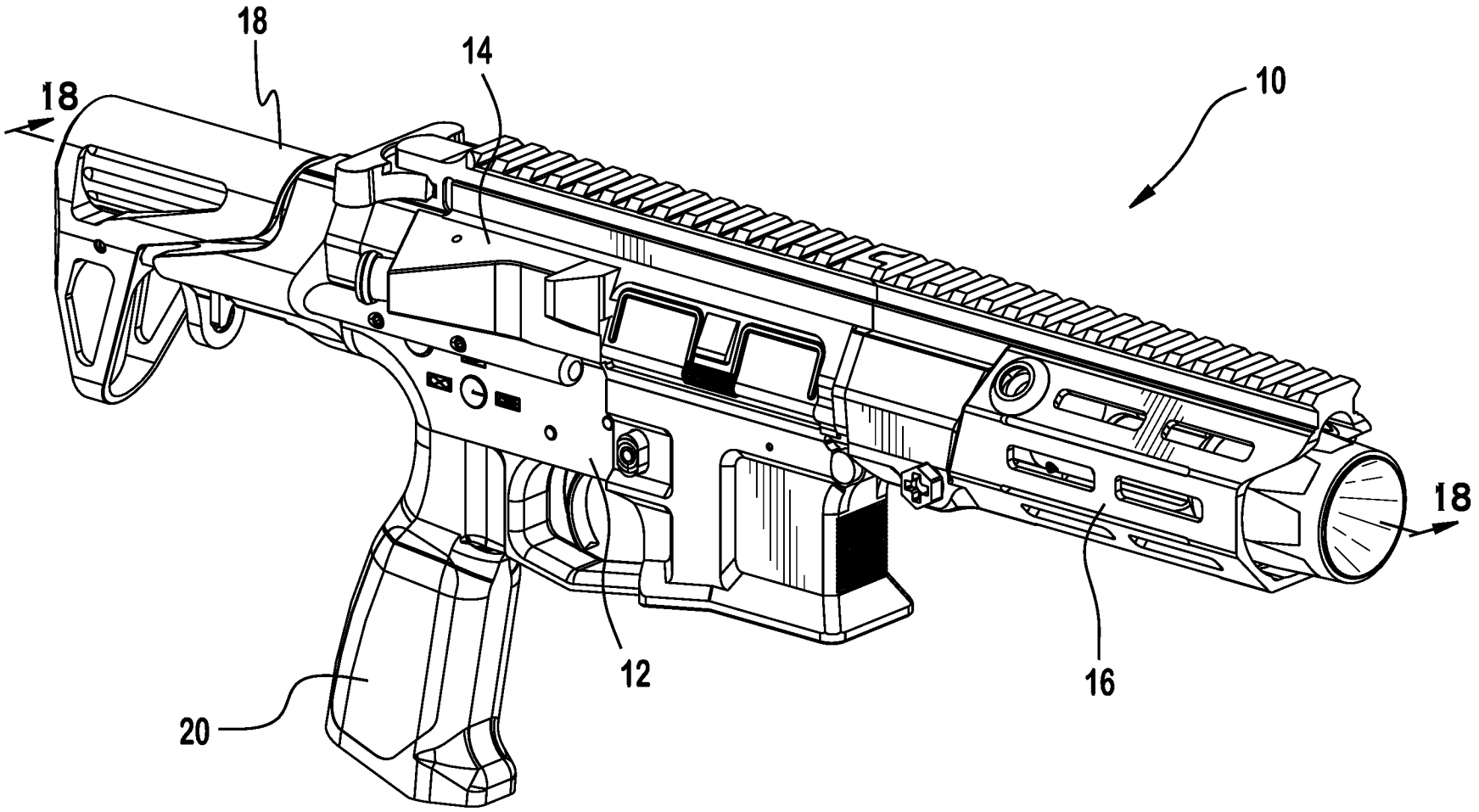
FIG. 1 is a perspective view of an exemplary embodiment of a firearm which includes a gas block for regulating gas flow to an autoloading firearm operating system in accordance with the present invention.
Figure 2:
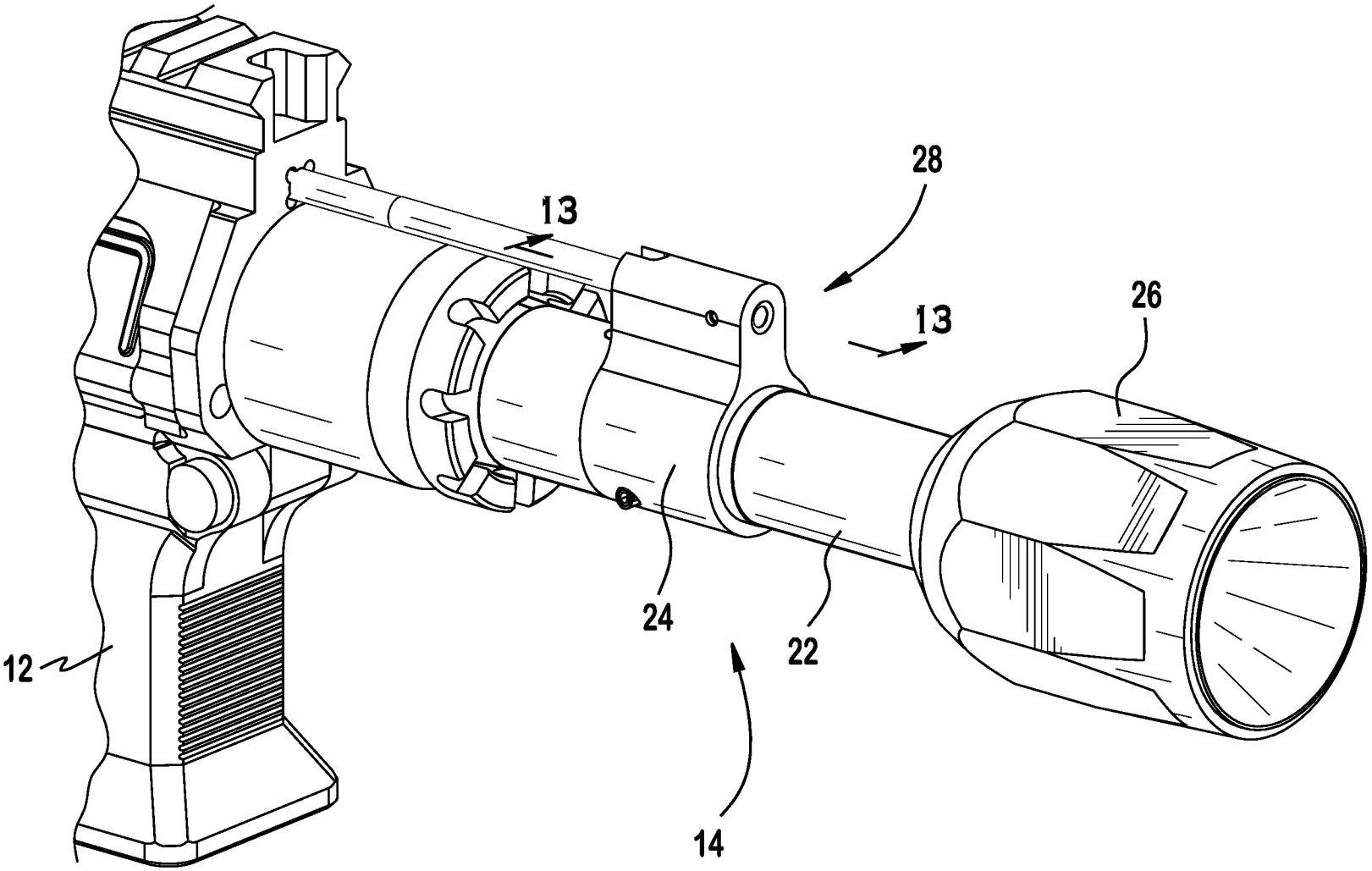
FIG. 2 is a partial perspective view of the firearm of FIG. 1 with the handguard removed and showing an exemplary embodiment of a gas block for regulating gas flow to an autoloading firearm operating system in accordance with the present invention.

FIG. 1 presents an illustrative firearm 10 with a gas block in accordance with the present invention. The firearm 10 further may include a lower receiver 12, an upper receiver group 14, a handguard 16, a butt-stock 18, and a pistol grip 20. Referring to FIG. 2, the upper receiver group 14 may include a barrel 22, a gas block 24 mounted on the barrel, and a muzzle booster 26 secured to the distal end of the barrel. Referring to FIG. 1, although the lower receiver 12 may be a M4 Mil-Spec lower receiver and the butt-stock 18 may be a sub-compact weapon (SCW) stock, other lower receivers and/or stocks may be used with the gas block and barrel assembly, as well as with other embodiments of the upper receiver group 14.

Figure 4:
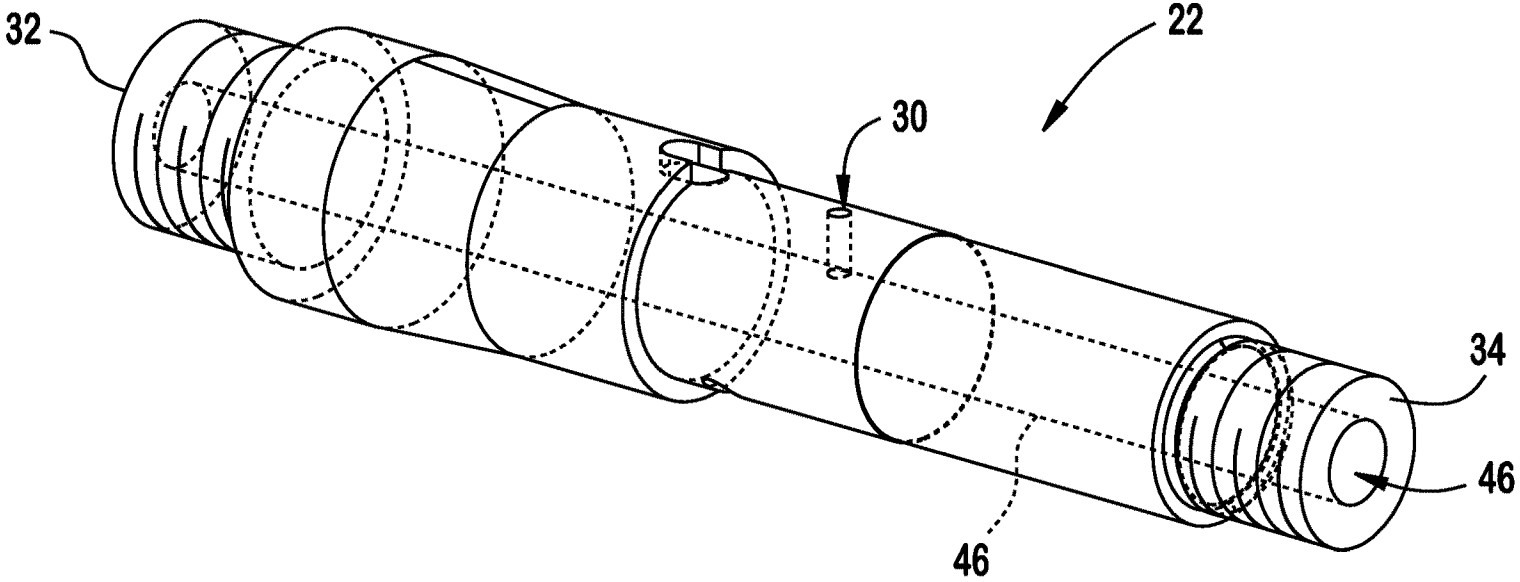
FIG. 4 is a perspective view of the barrel of FIG. 2.
Figure 5:
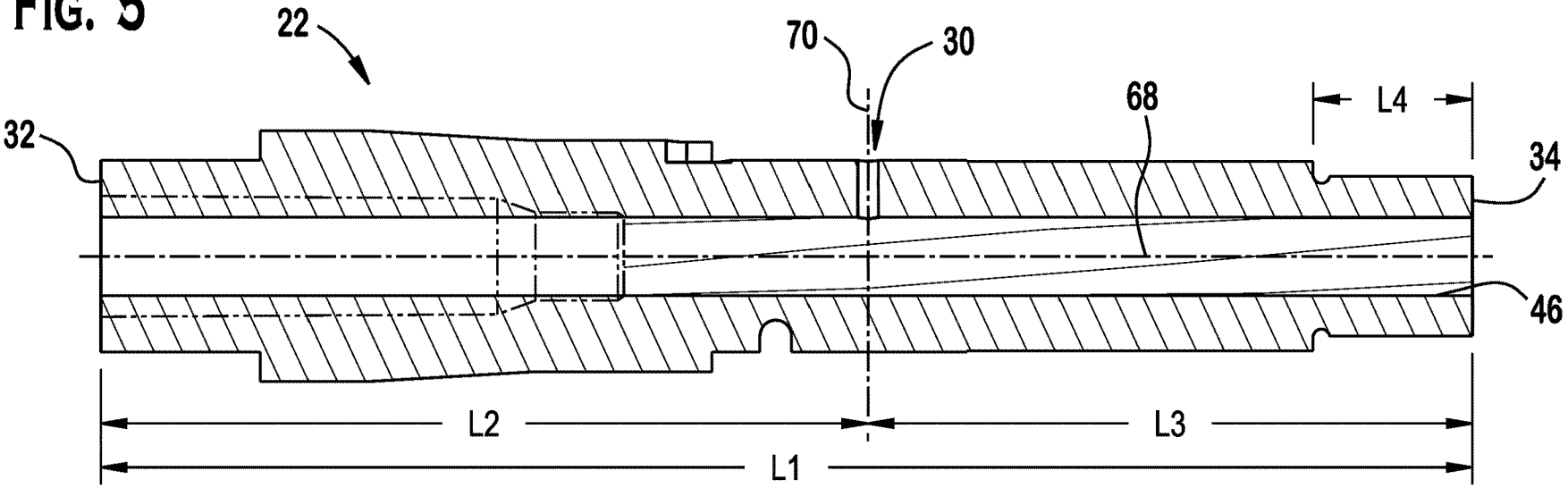
FIG. 5 is a cross-sectional view of the barrel of FIG. 4, along line 5-5.

Referring to FIG. 4 and FIG. 5, in the exemplary embodiment the barrel 22 may have a length L1 of approximately 5.5 inches; whereas, the overall length of the firearm may be approximately 18.75 inches. In another embodiment, the firearm 10 may include a barrel 22 having a length L1 of approximately 8.5 inches, and the overall length of the firearm may range from approximately 21.5 inches to approximately 23 inches. In yet another embodiment, the firearm 10 may include a barrel 22 having a length L1 of approximately 10.3 inches and the overall length of the firearm may range from approximately 23.5 inches to approximately 25 inches.

Figures 18, 19:
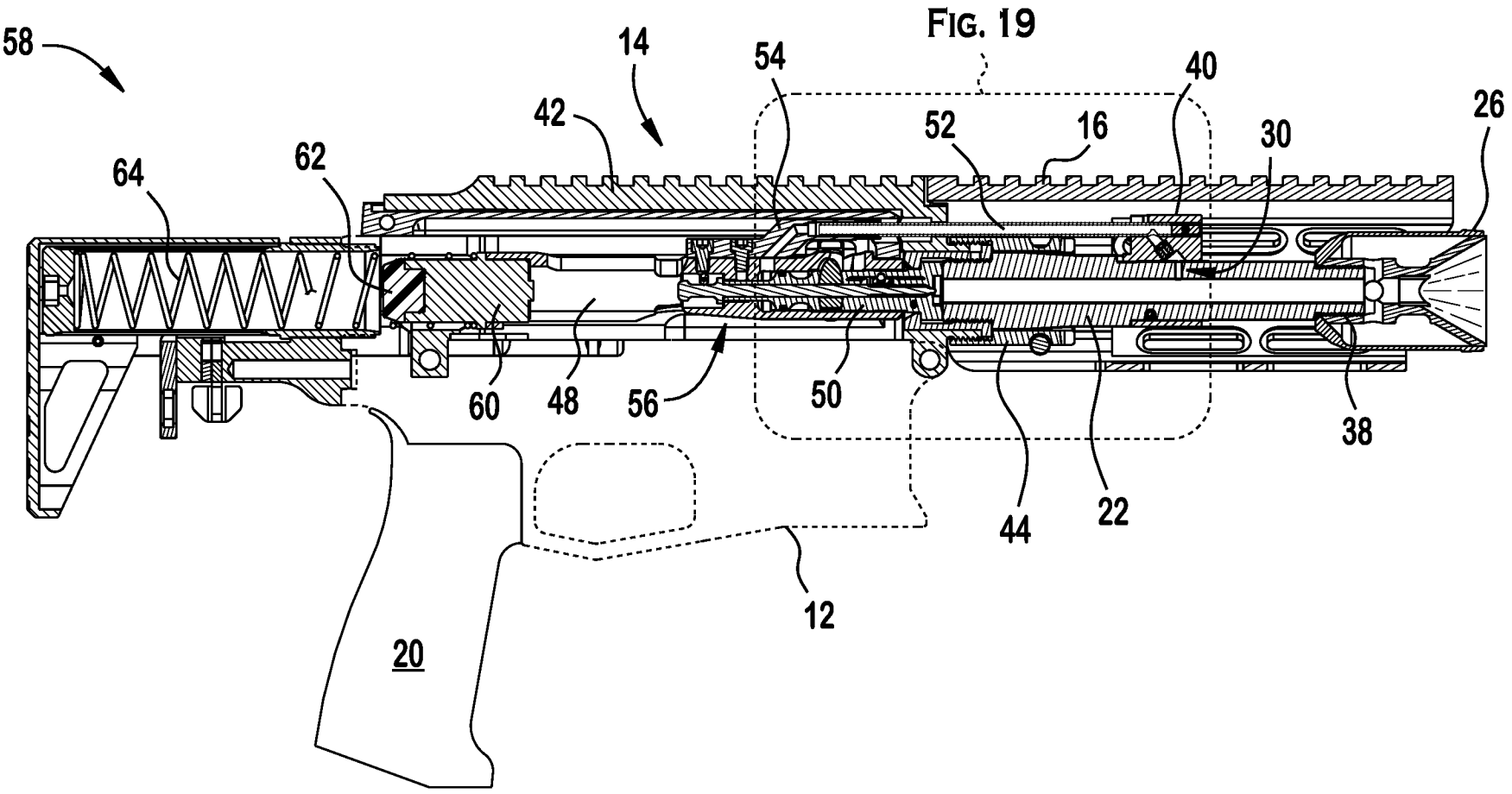
FIG. 18 is a cross-sectional view of part of the autoloading firearm of FIG. 1, along line 18-18.
FIG. 19 is a detail view of the upper receiver group and regulated gas block assembly of FIG. 18.
Figure 19:
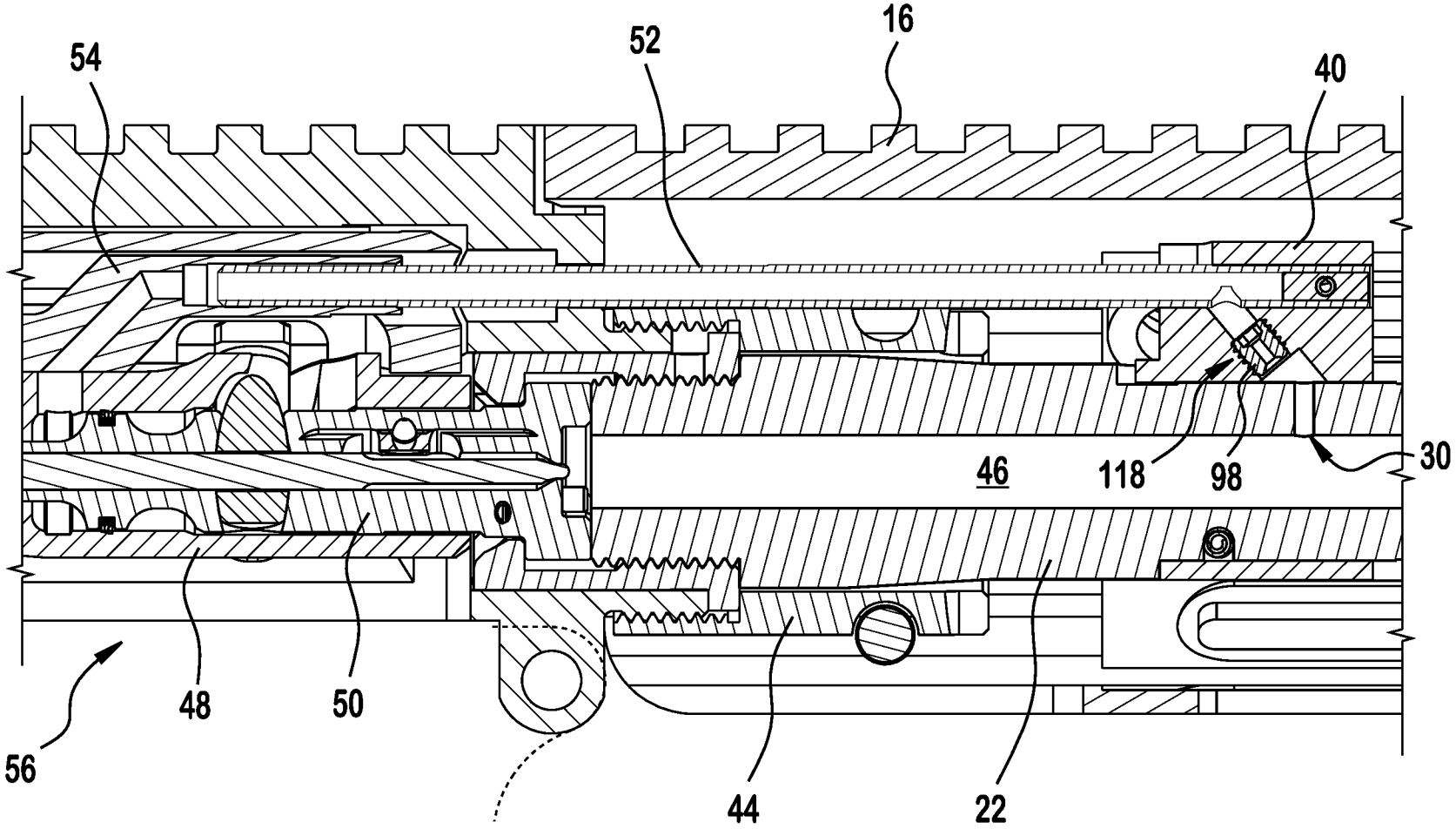

Additionally, the barrel 22 further may include a gas port 30. The gas port 30 may be located from the breach face 32 of the barrel 22 by a length L2. The muzzle 34 may be spaced from the gas port 30 by a length L3. Also, the distal end of the barrel 36 may include a threaded segment 38 of length L4. As shown in FIG. 18, the muzzle booster 26 may be connected to the barrel 22 using the threaded segment 38. Exemplary dimensions for the barrel of FIG. 4 are presented in Table 1 below.

TABLE 1

| Exemplary Barrel Dimensions | | | | | | | | |
|---|---|---|---|---|---|---|---|---|
| L1 (inches) | L2 (inches) | L3 (inches) | L4 (inches) | L5 (inches) | Θ1 Degrees | D1 (inches) | D2 (inches) | D3 (inches) |
| 5.375 | 3.005 | 2.368 | 0.625 | 0.221 | 90 | 0.308 | 0.751 | 0.081 |

Generally, however, the gas block 24 in accordance with the present invention may be used with a barrel having a length of up to 20 inches or greater. Preferably, the firearm 10 is an autoloading firearm and the gas block 24 regulates gas flow from the barrel 22 to the firearm operating system to induce the firearm's cycle of operation. Accordingly, the gas block 24 may be used in carbines, rifles, and other small arms weapons.

FIG. 18 and FIG. 19 depict selected components of the firearm 10 of FIG. 1, including the upper receiver group 14 and a regulated gas block assembly 40. The upper receiver group 14 may include an upper receiver 42, a barrel nut 44, and barrel 22. The barrel may further include a bore 46. Additionally, the firearm may include a bolt carrier 48, a bolt 50, and a gas tube 52. The bolt carrier 48 further may include a gas key 54. The bolt carrier 48, bolt 50, gas tube 52, and gas key 54 collectively may be referred to as a bolt carrier group (or BCG) 56. Moreover, the upper receiver group 14 further may include a muzzle booster 26 or a suppressor. An exemplary muzzle booster is disclosed in commonly owned, co-pending U.S. patent application Ser. No. 16/689,037, entitled "Apparatus and Method for Regulating Discharge Gases and Mounting a Component to a Firearm," filed on Nov. 19, 2019. As noted above, the '037 application is incorporated herein by reference in its entirety. The firearm further may include a buffer system 58. The buffer system 58 may include buffer body 60, a buffer body bumper 62, a buffer spring 64, and a buffer weight (inside the buffer body). Additionally, the barrel 22 may include a gas port 30 which extends from the bore 46 to an outer surface of the barrel 66. Generally, the regulated gas block assembly 40, gas tube 52, gas key 54, and gas port 30 may cooperate to selectively transfer discharge gases from the barrel 22 to the bolt carrier 48 to drive the bolt carrier group 56 toward the buffer body 60 and induce another cycle of operation.

Figure 6:
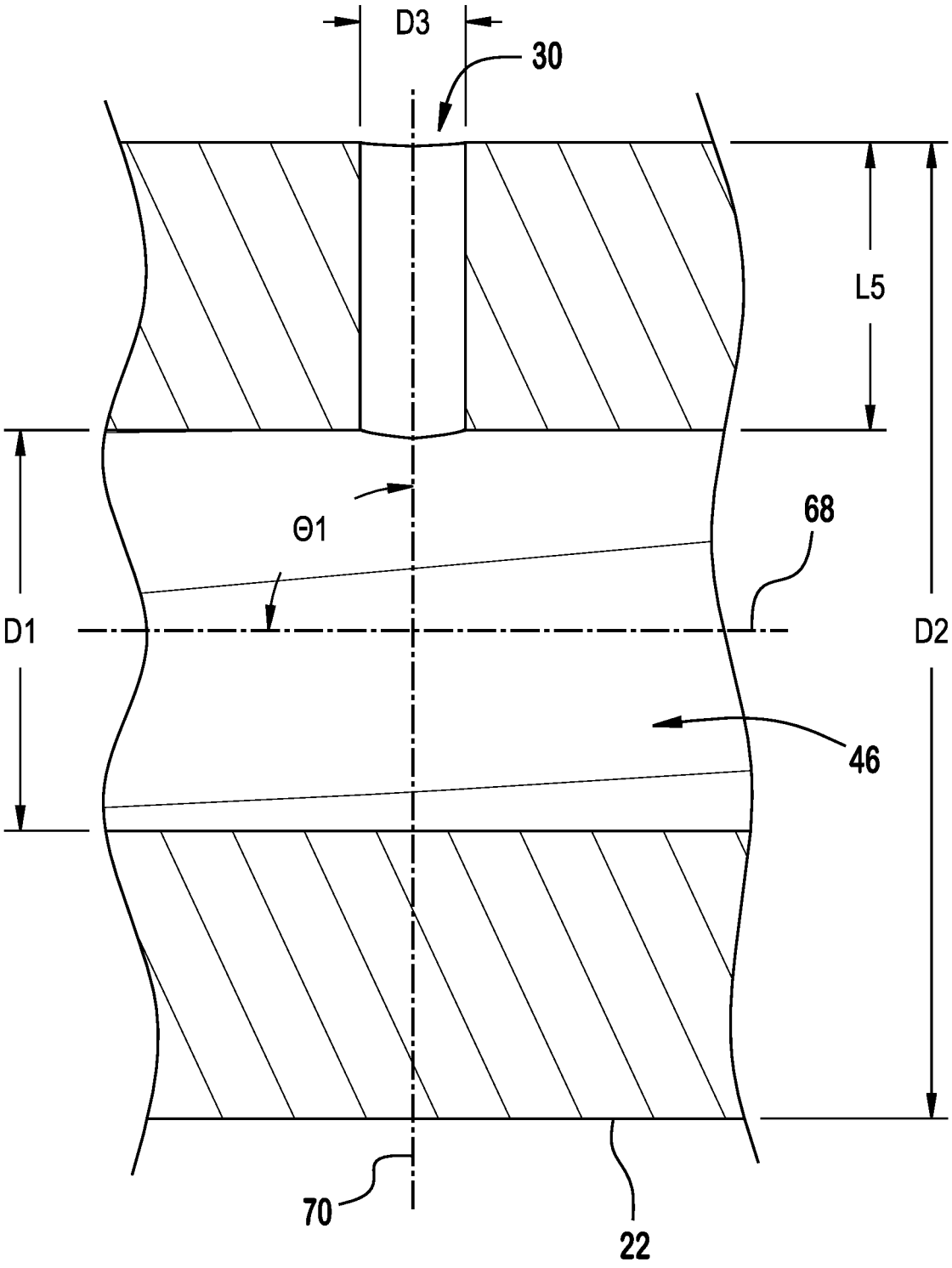
FIG. 6 is a detail view of the barrel and gas port of FIG. 5.

As shown in FIG. 6, the bore 46 may have a central axis 68. The bore 46 may have a circular shape perpendicular to the central axis. For instance, the bore may have a diameter D1 ranging from approximately 0.17 inches to approximately 0.50 inches. In the disclosed embodiment, the bore 46 has a diameter of approximately 0.308 inches. Generally, the barrel 22 may have a length L1 ranging from approximately 3.5 inches to approximately 20 inches. In the exemplary embodiment of FIG. 5, the barrel has a length of approximately 5.373 inches.

Also, the gas port 30 may have a longitudinal axis 70. The longitudinal axis 70 of the gas port 30 may be substantially perpendicular to the central axis 68 of the bore. The gas port 30 may have a circular shape perpendicular to the longitudinal axis 70. For example, without limitation, the gas port 30 may have a diameter D3 ranging from approximately 0.01 inches to approximately 0.10 inches. In the exemplary embodiment of FIG. 5, the gas port 30 has a diameter D3 of approximately 0.0810 inches. Generally, the gas port 30 may have a length L5 ranging from approximately 0.05 inches to approximately 0.5 inches. In the exemplary embodiment the gas port 30 has a length L5 of approximately 0.221 inches.

Figure 3:
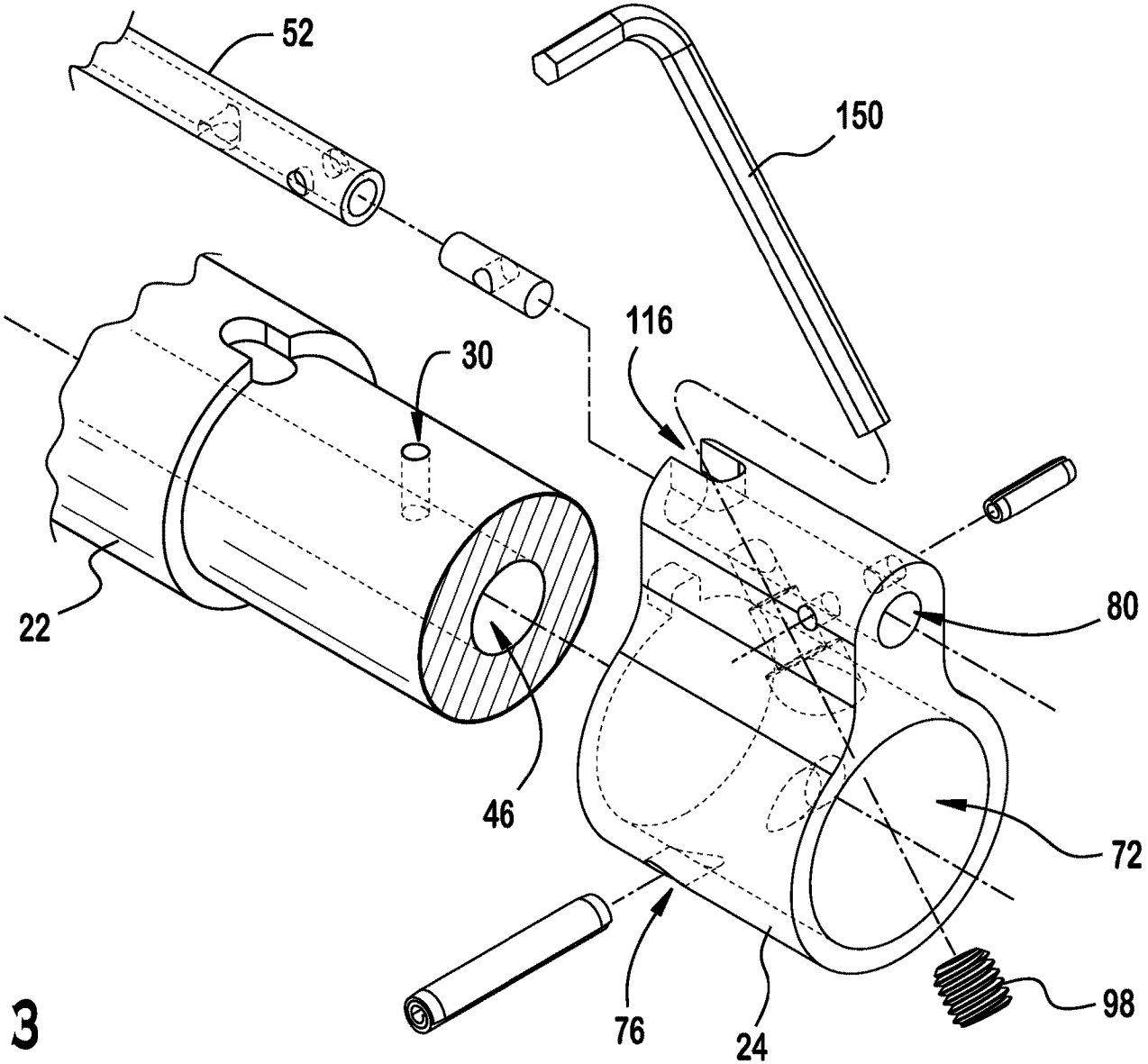
FIG. 3 shows an exploded view of the gas block and barrel interface of FIG. 2.
Figure 7:
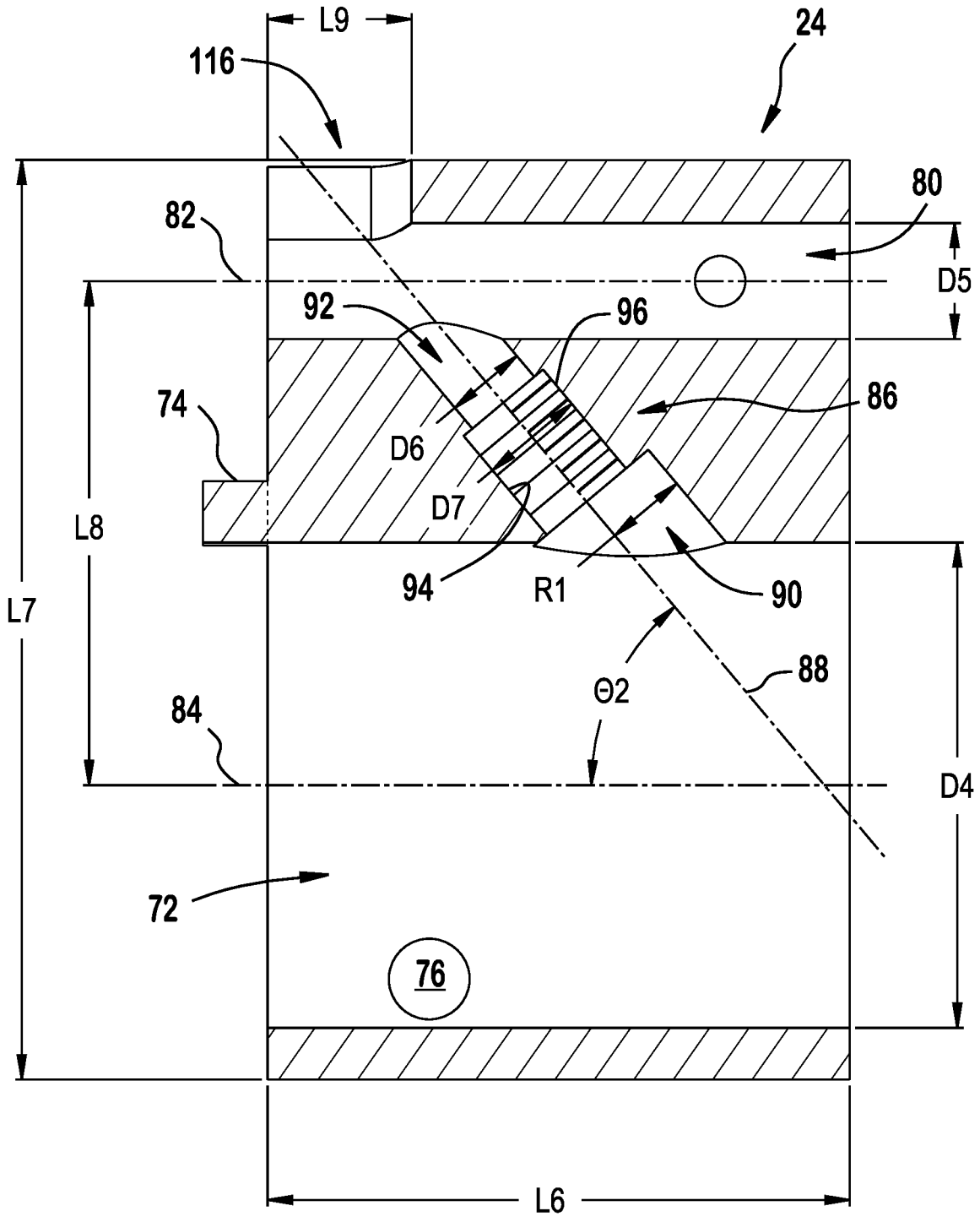
FIG. 7 is a cross-sectional view of the gas block of FIG. 3, along line 7-7.
Figure 8:
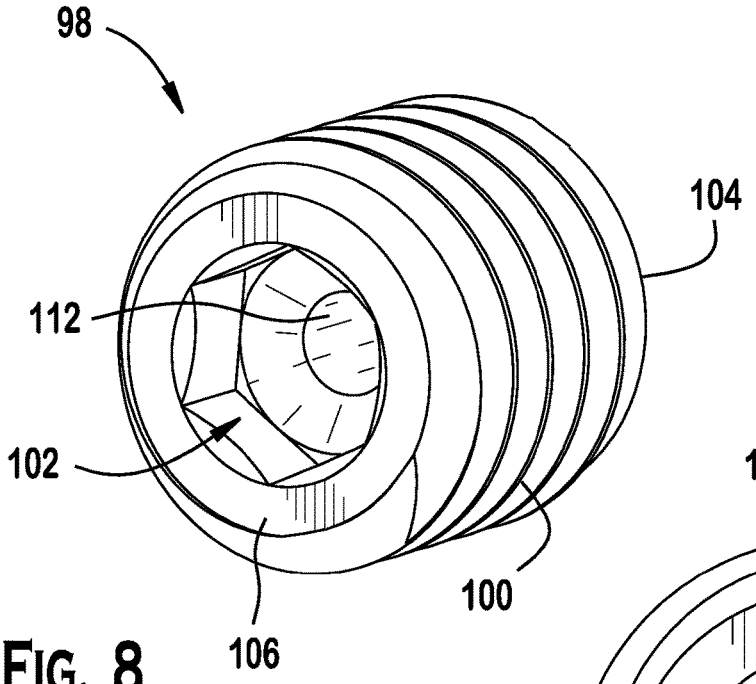
FIG. 8 is a perspective view of the gas regulator of FIG. 3.
Figure 9:
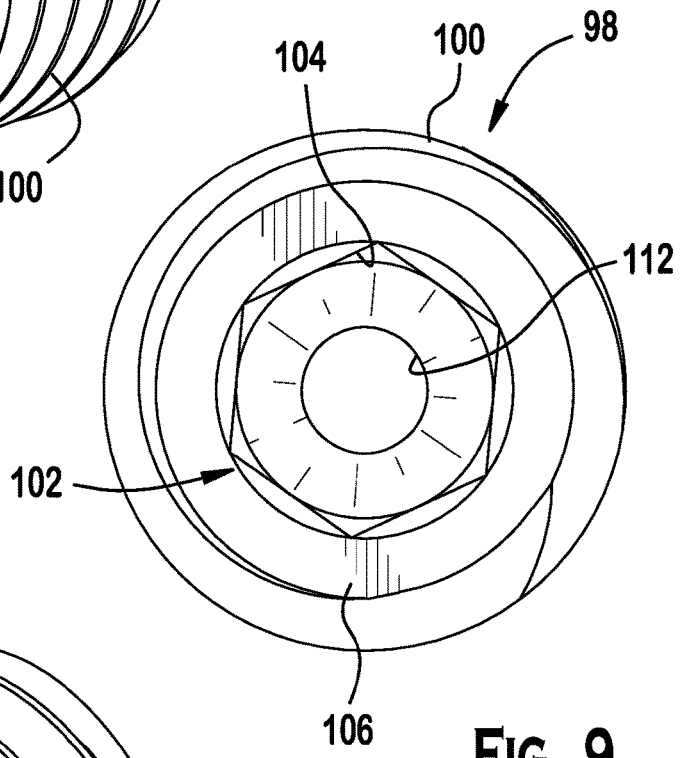
FIG. 9 is a top view of the gas regulator of FIG. 3.
Figure 10:
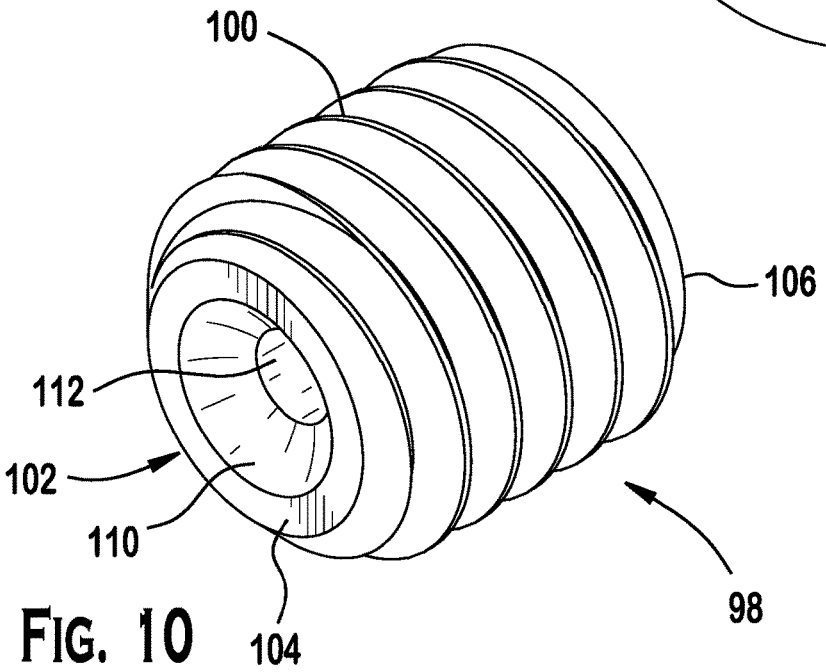
FIG. 10 is another perspective view of the gas regulator of FIG. 3.
Figure 11:
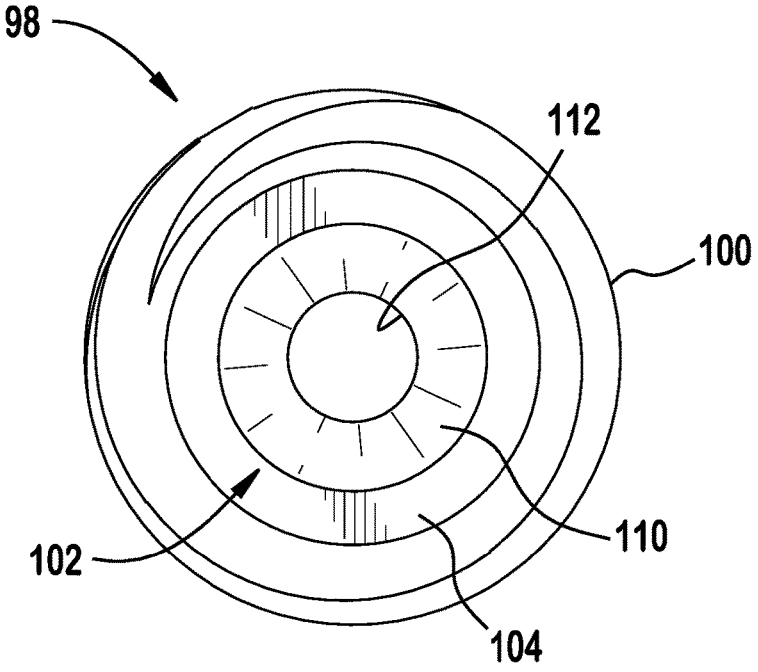
FIG. 11 is a bottom view of the gas regulator of FIG. 3.

Referring to FIG. 3 and FIG. 7, the regulated gas block assembly 40 may include a gas block 24. The gas block 24 may include a barrel receiving bore 72 which extends from one side of the gas block to another side of the gas block. The barrel receiving bore 72 may be configured and dimensioned to form a slip fit with the barrel 22. The gas block 24 further may include an orientation key 74 which mates with the barrel 22 to position the gas block 24 on the barrel. The gas block 24 further may include a cross pin receiving hole 76 which cooperates with a fastener receiving hole 78 in the barrel wall (see e.g. FIG. 13) to fasten the gas block 24 on the barrel.

The gas block 24 may further include a gas tube receiving bore 80. The gas tube receiving bore 80 may be configured and dimensioned to receive the distal end of the gas tube 52. The gas tube receiving bore 80 may extend from the one side of the gas block 24 to another side of the gas block. The gas tube receiving bore 80 may have a longitudinal axis 82. The gas tube receiving bore 80 may have a circular shape perpendicular to the longitudinal axis 82. For example, without limitation, the gas tube receiving bore 80 may have a diameter D5 ranging from approximately 0.08 inches to approximately 0.30 inches. In the disclosed embodiment, the gas tube receiving bore 80 has a diameter D5 of approximately 0.181 inches. The longitudinal axis 82 of the gas tube receiving bore may be parallel to the central axis 84 of the barrel receiving bore 72.

The gas block 24 may further include an intermediate passage 86 extending between the barrel receiving bore 72 and the gas tube receiving bore 80. The intermediate passage 86 may have a longitudinal axis 88. Preferably, the longitudinal axis 88 of the intermediate passage 86 and the central axis 84 of the barrel receiving bore 72 may define an oblique angle Θ2. For example, the angle Θ2 defined by the longitudinal axis 88 of the intermediate passage 86 and the central axis 84 of the barrel receiving bore 72 may range from approximately 30 degrees to approximately 90 degrees. Most preferably, in the disclosed embodiment the angle Θ2 defined by the longitudinal axis 88 of the intermediate passage and the central axis 84 of the barrel receiving bore is approximately 50 degrees. Still, in some embodiments the angle Θ2 may be a right angle.

The intermediate passage 86 may include a starting gas hole 90 which intersects the barrel receiving bore 72 and extends toward the gas tube receiving bore 80. The starting gas hole 90 may have a cross-section perpendicular to the longitudinal axis 88 of rounded shape. For example, the starting gas hole 90 may have a radius R1 ranging from approximately 0.01 inches to approximately 0.250 inches. In the disclosed embodiment, the starting gas hole 90 may have a radius R1 of approximately 0.125 inches.

The intermediate passage further may include an exiting gas hole 92 which intersects the gas tube receiving bore 80 and extends toward the barrel receiving bore 72. The exiting gas hole 92 may have a cross-section perpendicular to the longitudinal axis 88 of circular shape. For example, the exiting gas hole 92 may have a diameter D6 ranging from approximately 0.02 inches to approximately 0.250 inches. In the disclosed embodiment, the exiting gas hole 92 has a diameter D6 of approximately 0.125 inches.

Figure 12:
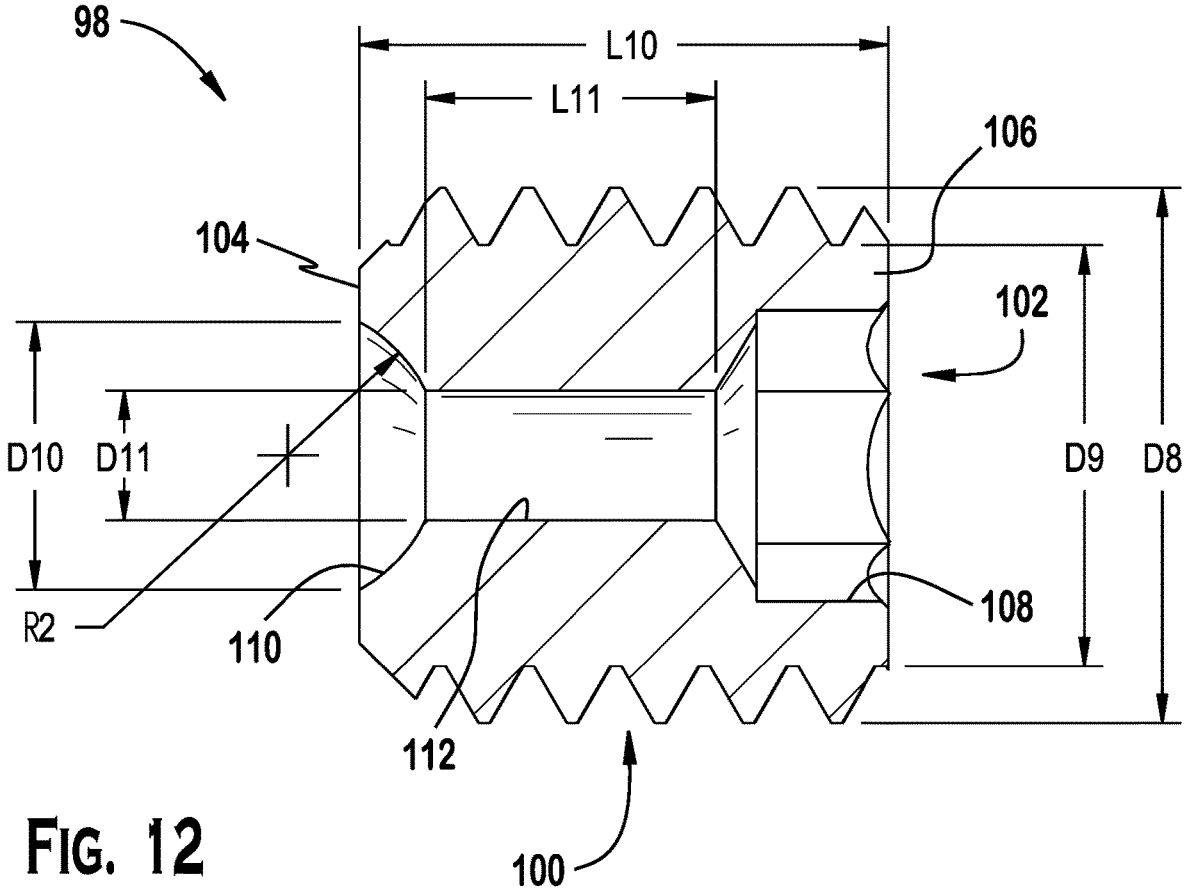
FIG. 12 is a cross-sectional view of the gas regulator of FIG. 10, along line 12-12.
Figure 13:
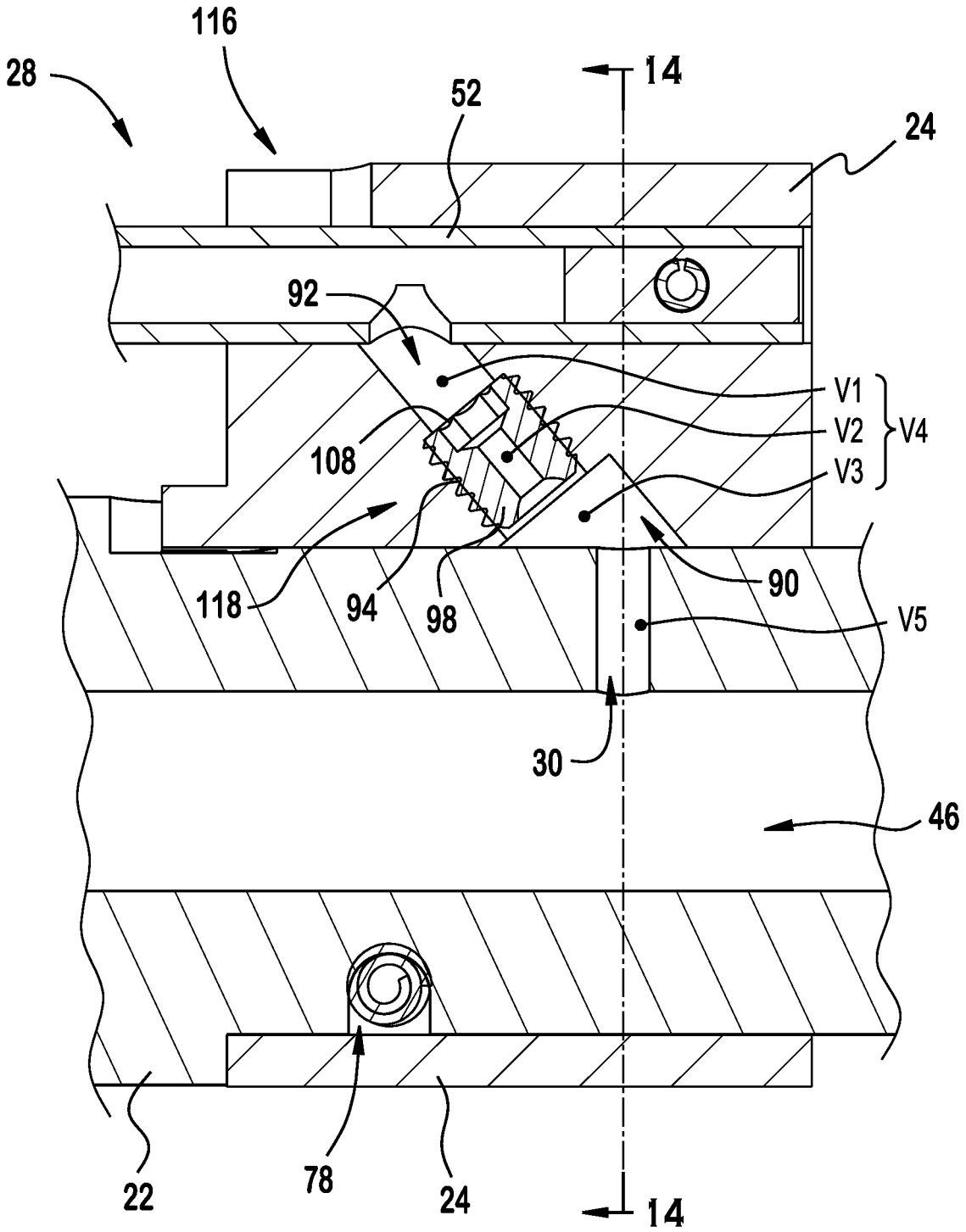
FIG. 13 is a cross-sectional view of the gas block and barrel interface of FIG. 2, along line 13-13 showing the gas regulator in a preferred orientation.

Further still, the intermediate passage 86 may include a gas regulator seat 94 between the starting gas hole 90 and the exiting gas hole 92. The gas regulator seat 94 may have a cross-section of circular shape perpendicular to the longitudinal axis. For example, the gas regulator seat 94 may have a diameter ranging from approximately 0.05 inches to approximately 0.250 inches. In the disclosed embodiment, the gas regulator seat 94 has a diameter D7 of approximately 0.177 inches. The sidewall of the segment may include a screw thread 96. As shown in FIGS. 7, 12 and 13, the screw thread 96 may be configured and dimensioned to mate with a gas regulator 98. For example, the gas regulator 98 may include a screw thread 100 that is configured and dimensioned to mate with the screw thread 96 of the regulator seat 94. The mating screw threads 96, 100 may be used to position and secure the gas regulator 98 within the intermediate passage 86. Exemplary dimensions for an embodiment of the gas block of FIG. 12 are presented in Table 2 below.

TABLE 2

Exemplary Gas Block Dimensions

| D4 (inches) | D5 (inches) | D6 (inches) | D7 (inches) | R1 (inches) | Θ2 (degrees) | L6 (inches) | L7 (inches) | L8 (inches) | L9 (inches) |
|---|---|---|---|---|---|---|---|---|---|
| 0.750 | 0.180 | 0.125 | 0.197 | 0.125 | 50 | 0.900 | 1.423 | 0.780 | 0.223 |

Referring to FIGS. 8, 9, 10, 11 and 13, the gas regulator 98 may have a complementary shape with respect to the gas regulator seat 94. For example, the gas regulator 98 may have generally circular cylindrical shape with an external screw thread. As described above, the screw thread on the gas regulator 98 may be configured and dimensioned to mate with screw threads 96 of the gas regulator seat 94. The gas regulator 98 may include a gas regulating hole 102. The gas regulating hole 102 may extend from one end 104 of the gas regulator to the opposite end 106 of the gas regulator. Referring to FIG. 13, the gas regulating hole 102 may fluidly connect the starting gas hole 90 and the exiting gas hole 92 when properly installed in the gas regulator seat 94.

As shown in FIG. 12, the gas regulating hole 102 may include a keyed segment 108, a nozzle segment 110 and an intermediate segment 112 between the keyed segment and the nozzle segment. In the disclosed embodiment, the keyed segment 108 forms a generally hexagonal cross-section perpendicular to the longitudinal axis 114 of the intermediate segment. For example, the keyed segment 108 may be configured and dimensioned to receive a drive tool 150, such as an Allen wrench. Exemplary dimensions for an embodiment of the gas regulator of FIG. 12 are presented in Table 3 below.

TABLE 3

Exemplary Gas Regulator Dimensions

| D8 (inches) | D9 (inches) | D10 (inches) | D11 (inches) | R2 (inches) | L10 (inches) | L11 (inches) |
|---|---|---|---|---|---|---|
| 0.190 | 0.149 | 0.095 | 0.046 | 0.054 | 0.188 | 0.103 |

Figure 14:
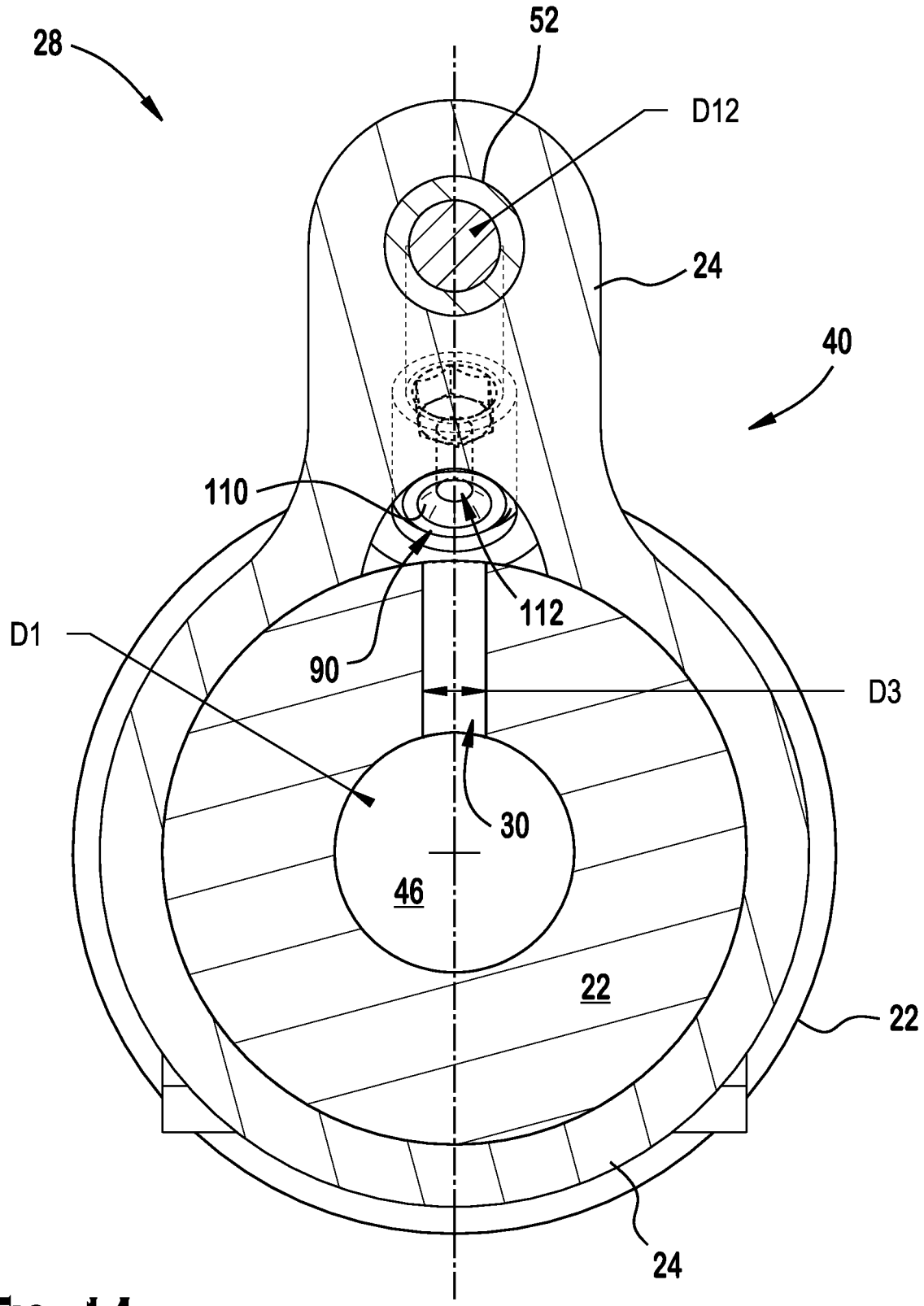
FIG. 14 is a cross-sectional view of the gas block and barrel interface of FIG. 13, along line 14-14.
Figure 15:
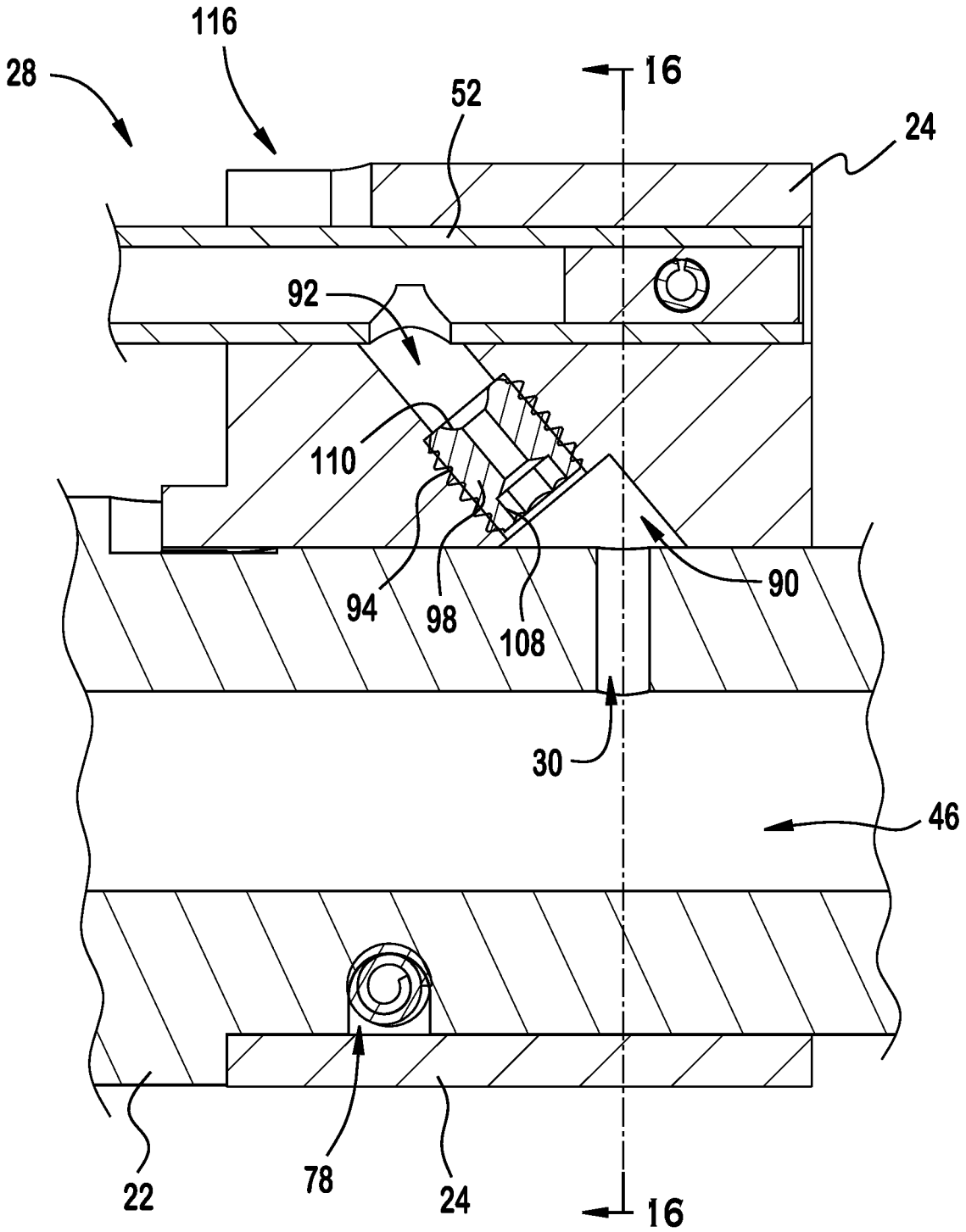
FIG. 15 is a cross-sectional view of the gas block and barrel interface of FIG. 2, along line 13-13 showing the gas regulator in an alternative orientation.
Figure 16:
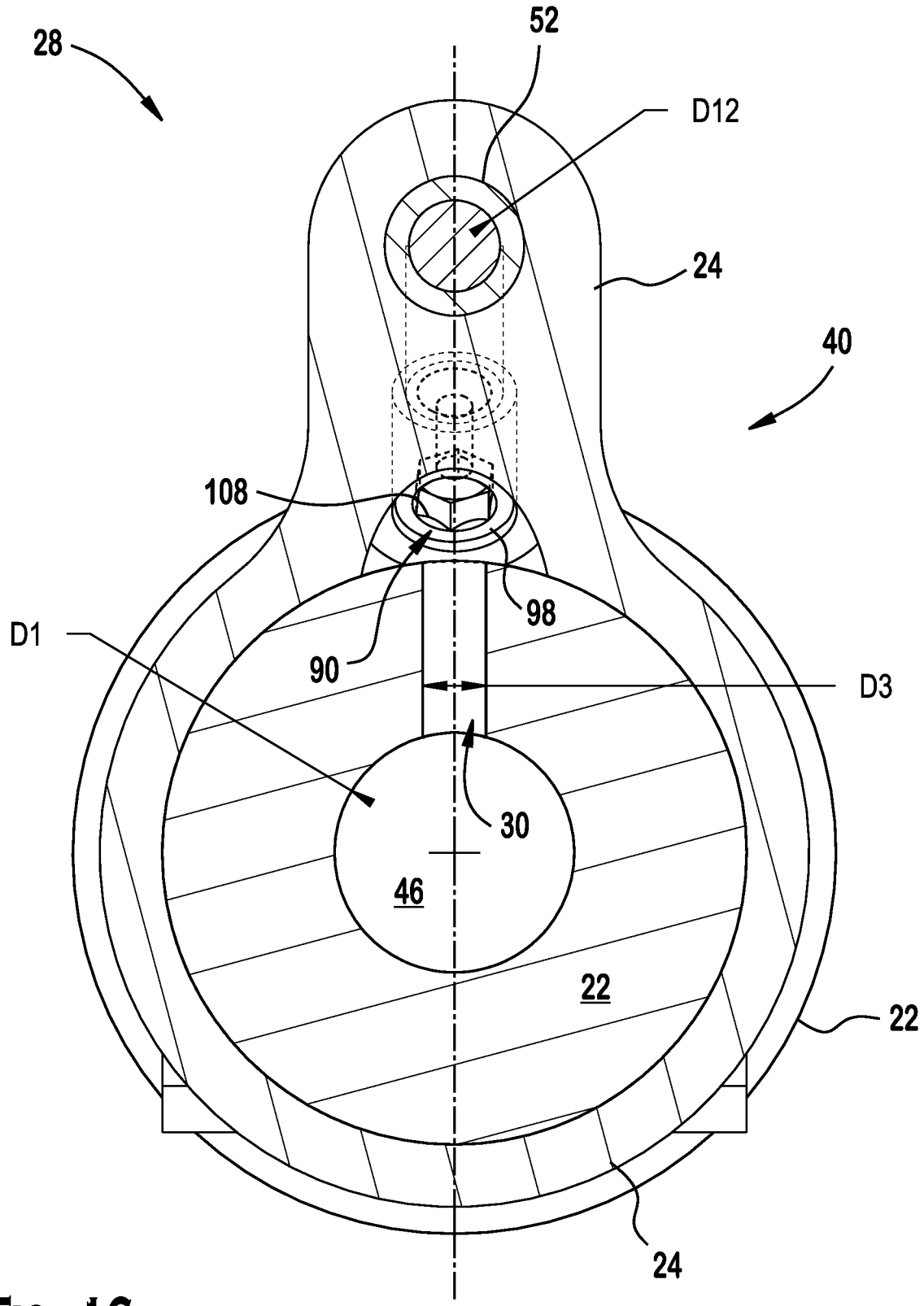
FIG. 16 is a cross-sectional view of the gas block and barrel interface of FIG. 15, along line 16-16.

Referring to FIG. 13 and FIG. 14, the nozzle segment 110 may be configured and dimensioned to transfer discharge gases from the starting gas hole 90 to the intermediate segment 112. By orienting the gas regulator 98 in this manner, the keyed segment 108 may be subjected to less erosion, and thus facilitate removal and replacement of the gas regulator for maintenance or operational considerations. Nevertheless, the gas regulator 98 may be oriented with the keyed segment 108 next to the starting gas hole 90, as shown in FIG. 15 and FIG. 16.

Referring to FIGS. 8, 9, 10, 11 and 12, the intermediate segment 112 further may be configured and dimensioned to allow a target volume of discharge gases to transit the intermediate passage 86 during each cycle of operation. For example, the intermediate segment 112 may have a cross-section of circular shape perpendicular to the longitudinal axis 88. In one embodiment, the intermediate passage 86 may have a diameter D11 of approximately 0.077 inches. In another embodiment, the intermediate passage 86 may have a diameter D11 of approximately 0.079 inches. The dimensions of the gas regulating hole 102 may be optimized for a selected firearm configuration or mode of operation.

Referring to FIG. 3 and FIG. 13, the gas block 24 may include an access portal (e.g., an escarpment) 116 proximate to the gas tube receiving bore 80 and the exiting gas hole 92. With the gas tube 52 removed, the access portal provides access to the exiting gas hole 92 such that a drive tool (e.g., an Allen wrench) 150 may be positioned within the exiting gas hole 92. If—as preferred—the gas regulator 98 is oriented with the keyed segment 108 next to the exiting gas hole, then the tool may be positioned into the keyed segment 108. The tool then may be rotated to adjust the position of the gas regulator 98. Replacement of the gas regulator 98 may be accomplished by uncoupling the gas block 24 from the barrel 22 and gas tube 52, and then using the drive tool (e.g., Allen wrench) 150 to unscrew the gas regulator 98 from the gas regulator seat 94 in its entirety before removing the gas regulator 98 from the starting gas hole 90.

Accordingly, the intermediate passage 86 may define a volume V4 between the gas port 30 and the gas tube 52 through which discharge gases from the barrel are directed to the gas key 54 of the bolt carrier 48. Similarly, the exiting gas hole 92 and the entering gas hole 90 may have respective volumes V1 and V3 through which discharge gases from the barrel transit as the discharge gases are directed to the gas key 54 of the bolt carrier 48. Also, the gas hole 102 of the gas regulator 98 may have a volume V2 through which discharge gases from the barrel transit as the discharge gases are directed to the gas key 54 of the bolt carrier 48. Accordingly, the volume V4 of intermediate passage 86 may be the sum of exiting gas hole 92 volume V1, the entering gas hole volume V3, and the gas hole 102 volume V2. Exemplary values—in units of cubic inches—for the respective volumes of the segments which form the intermediate passage in an exemplary embodiment of the gas block and barrel assembly 40 of FIG. 13 are presented in Table 4 below.

TABLE 4

| Exemplary Intermediate Passage Segment Volumes | | | |
|---|---|---|---|
| V1 (inch^3) | V2 (inch^3) | V3 (inch^3) | V4 (inch^3) |
| .00166 | .00094 | .00440 | .00700 |

As previously described, the intermediate segment 112 may be configured and dimensioned to allow a target volume of discharge gases to transit the intermediate passage 86 during each cycle of operation.

Referring to FIG. 19, the gas regulating hole 102 may erode and enlarge from use. As the gas hole enlarges, more gas may be allowed into the gas system of the weapon, and the weapon may begin to over cycle because too much energy is input into the recoil mechanism too fast. As the gas regulator 98 is in the gas block 24 instead of integrated directly into the barrel 22, the user (or the user's armorer) may replace the gas regulator 98 in the gas block 24 whenever needed. This capability allows more use of the barrel 22 because its gas port can continue to erode, provided that the regulated gas block assembly 40 is still in service. For at least this reason, the regulated gas block assembly 40 may significantly increase the lifetime of the weapon's barrel 22.

Further, the regulated gas block 40 may be replaced in its entirety for use with the same barrel 22, and thus may provide enhanced flexibility and potential cost saving in the operation and maintenance of the firearm. Moreover, the regulated gas block assembly 40 preferably incorporates an angled gas port 118 instead of a perpendicular one relative to the bore 46 of the barrel 22. The angled gas port 118 may allow for enhanced change in momentum of the discharge gases per unit time. This may moderate the exchange of energy from the expanding discharge gases into potential energy of the buffer spring 64, and result in less wear on moving components involved in the cycle of operation.

Figure 17:
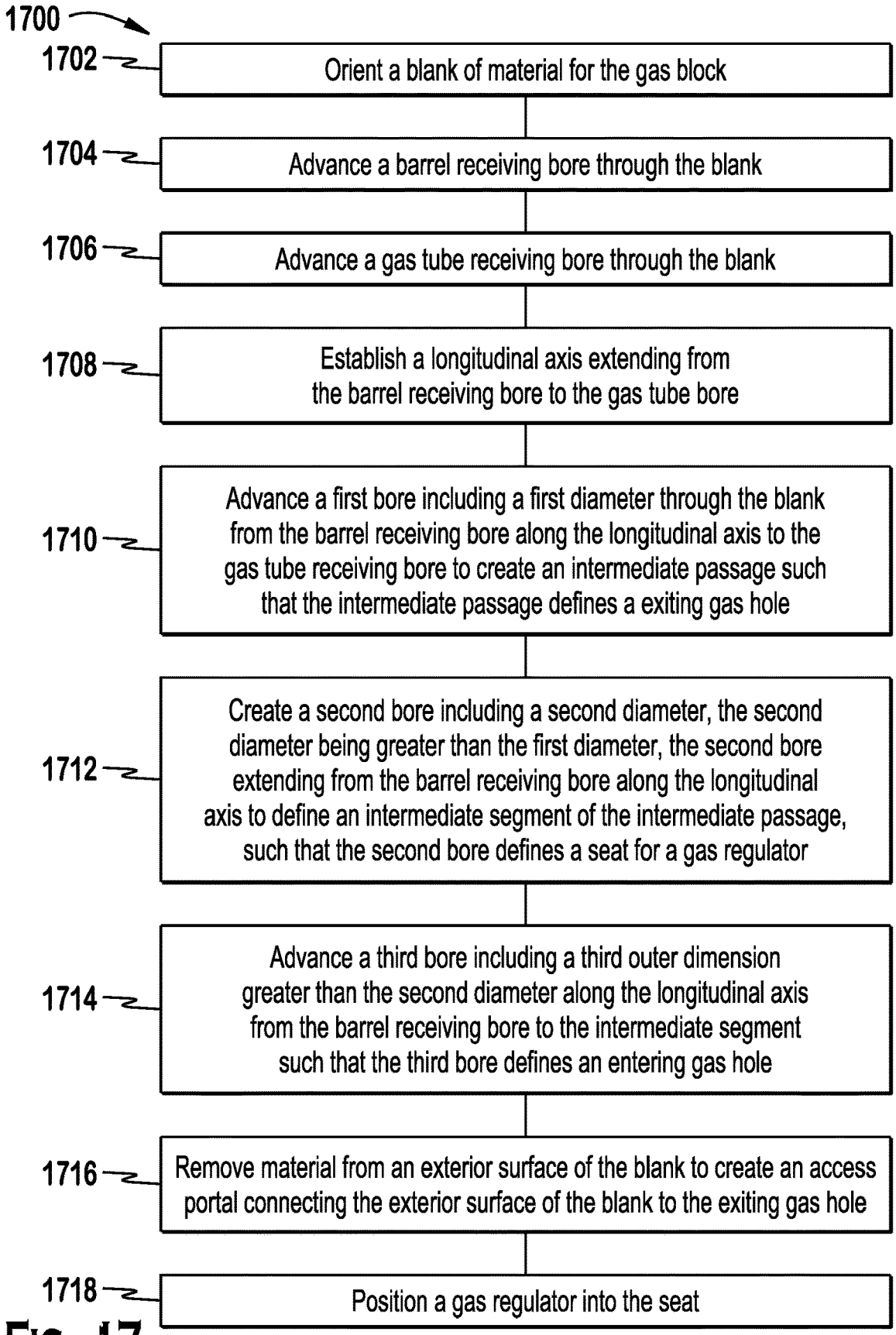
FIG. 17 is a flow chart of a method for fabricating a gas block for a firearm gas system.

The regulated gas block 40 may be manufactured in an additive or subtractive process. Preferably the gas block 24 may be formed from a blank of suitable material (e.g., a steel alloy, titanium alloy, or other metal alloy). For example, a method 1700 for fabricating the gas block 24 from a blank of suitable material is outlined in FIG. 17. More particularly, the method may include orienting a blank of suitable material for the gas block 1702. Additionally, the method may include advancing a barrel receiving hole through the blank 1704. The method may include advancing a gas tube receiving bore through the blank 1706. Also, the method may include establishing a proposed longitudinal axis extending from the barrel receiving bore to the gas tube bore 1708. The method further may include advancing a first bore including a first diameter through the blank from the barrel receiving bore along the proposed longitudinal axis to the gas tube receiving bore to create an intermediate passage such that the intermediate passage includes a longitudinal axis and defines an exiting gas hole 1710. The method also may include creating a second bore including a second diameter greater than the first diameter, the second bore extending along the longitudinal axis to define an intermediate segment of the intermediate passage such that the second bore defines a seat for a gas regulator 1712. The method may further include advancing a third bore having a third outer dimension along the longitudinal axis from the barrel receiving bore to the intermediate segment such that the third bore defines an entering gas hole 1714. The method may include removing material from an exterior surface of the blank to create an access portal connecting the exterior surface of the blank to the exiting gas hole 1716. Also, the method may include positioning a gas regulator into the seat 1718.

Figure 20:
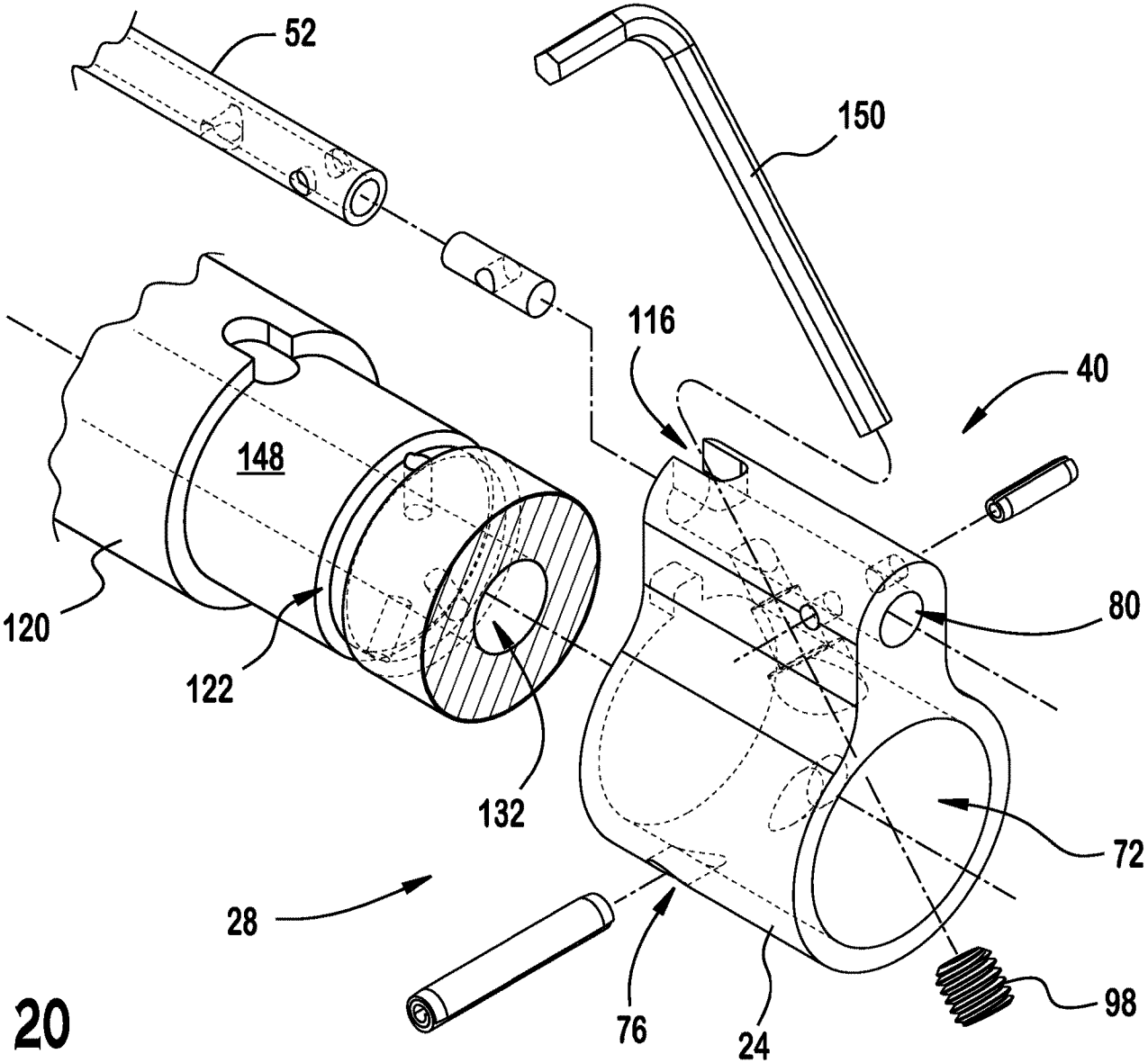
FIG. 20 is an exploded view of another embodiment of the gas block and barrel interface of FIG. 2.
Figure 21:
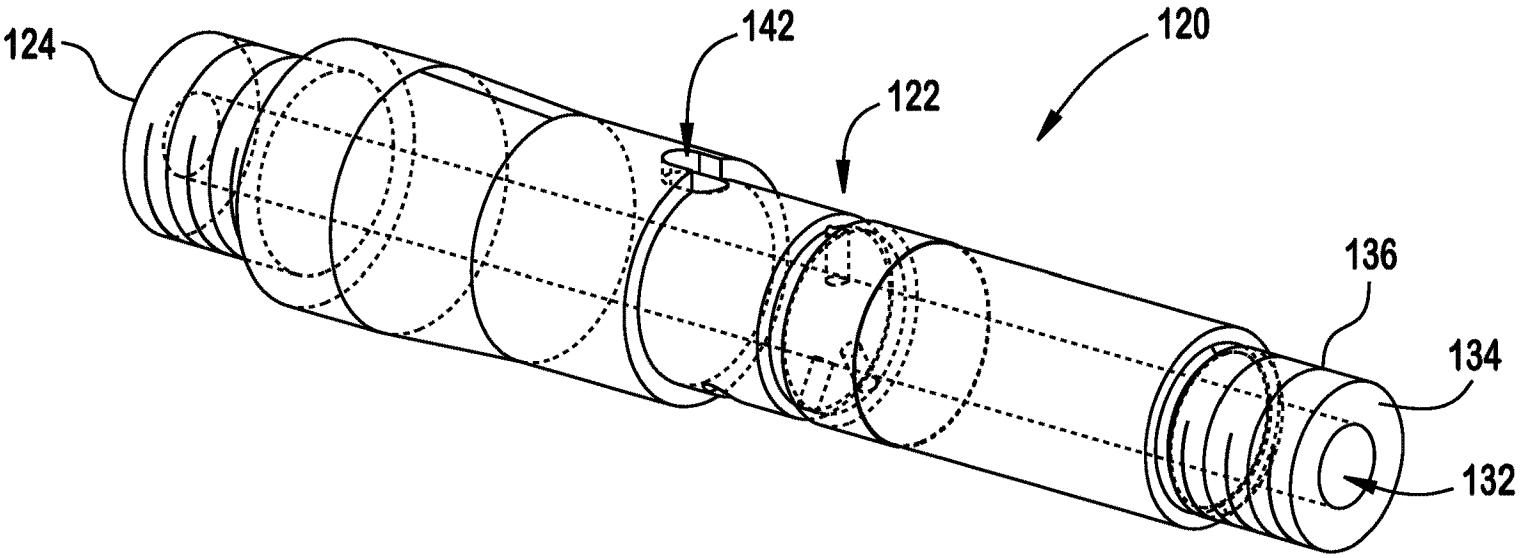
FIG. 21 is a perspective view of the barrel of FIG. 20.
Figure 22:
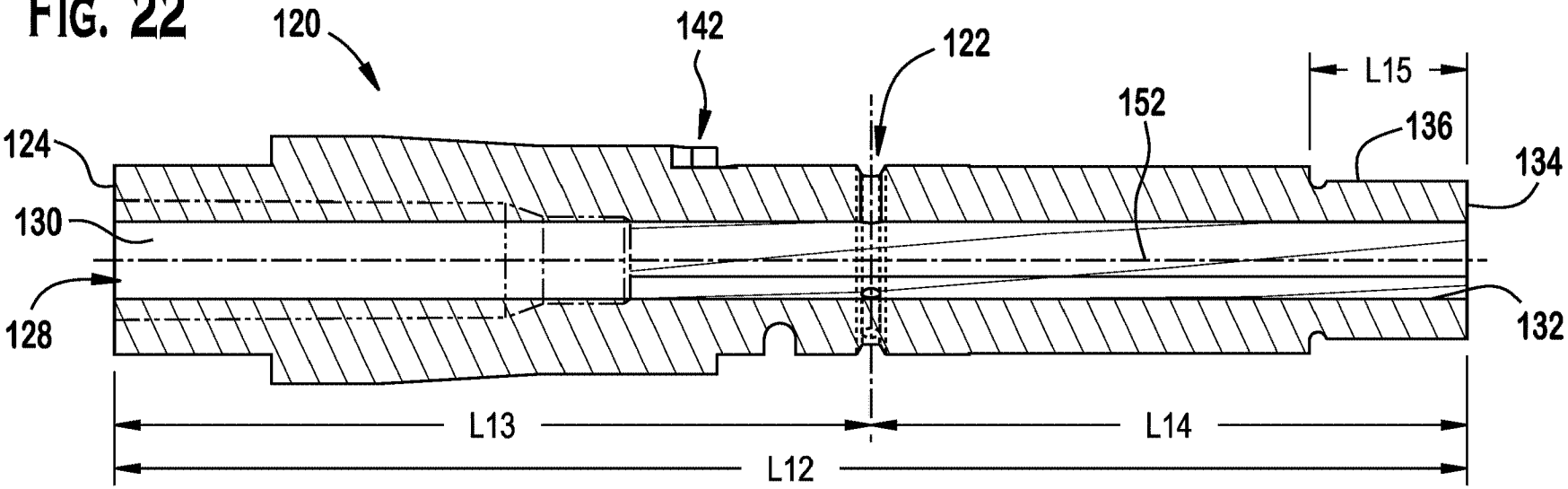
FIG. 22 is a cross-sectional view of the barrel of FIG. 21 along line 22-22.

FIG. 20 and FIG. 21 show an exemplary embodiment of a barrel 120 with a gas ring recess 122 in accordance with the present invention. The barrel 120 may include a breech end 124 which includes a breech face 126, a breech 128 that provides access to the barrel's chamber, and a chamber 130. The barrel 120 further may include a bore 132, and a muzzle end 134. Referring to FIG. 22, the chamber 130 and bore 132 may be configured and dimensioned for a particular type of ammunition cartridge. For example, the barrel 120 may be chambered for 7.62×39 mm, 5.56 NATO, 300 BLK, or other ammunition cartridges. The breech end 124 further may include a threaded portion 136 that is configured and dimensioned to mate with a barrel extension.

The bore 132 may extend from the chamber 130 to the muzzle end 134. Generally, the bore 132 may include rifling. Also, the barrel 120 may include a tapered segment 138 and a step 140 which may include a key 142 for receiving a gas block assembly. Moreover, the barrel 120 may include a gas ring recess 122 situated between the key 142 and the muzzle end 134 of the barrel 132. For example, referring to FIG. 21 and FIG. 25, the gas ring recess 122 may include a circumferential groove 144 and one or more radial ports 146 extending from the bore 132 to the circumferential grove 144. Although the circumferential grove 144 may extend around the outer surface 148 of the barrel to form a ring, in other embodiments the circumferential groove 144 may traverse a more limited portion of the outer surface.

Figure 24:
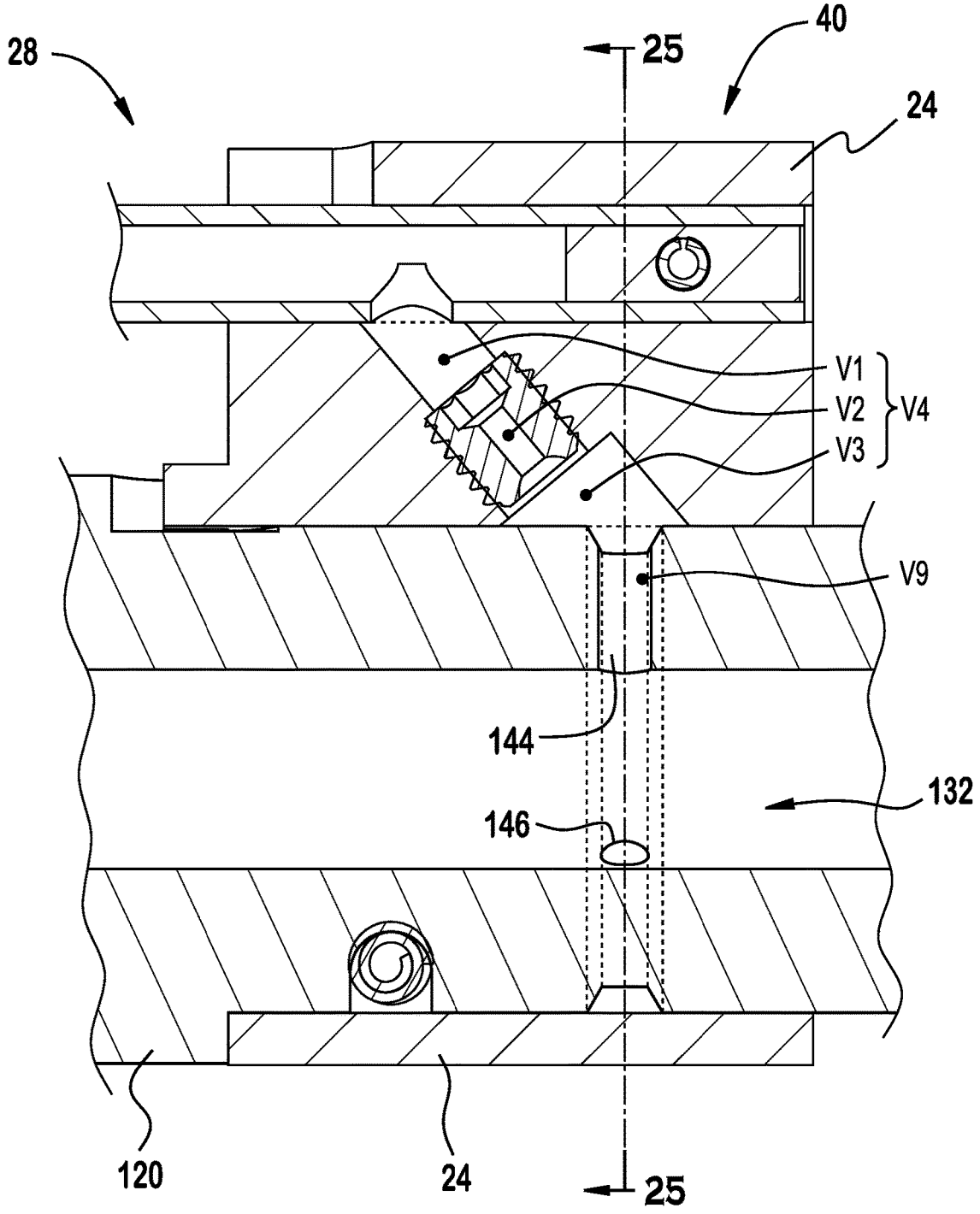
FIG. 24 is a cross-sectional view of the gas block and barrel interface of FIG. 2, along line 13-13 showing the gas block of FIG. 7 and the barrel of FIG. 21 in a preferred orientation.
Figure 25:
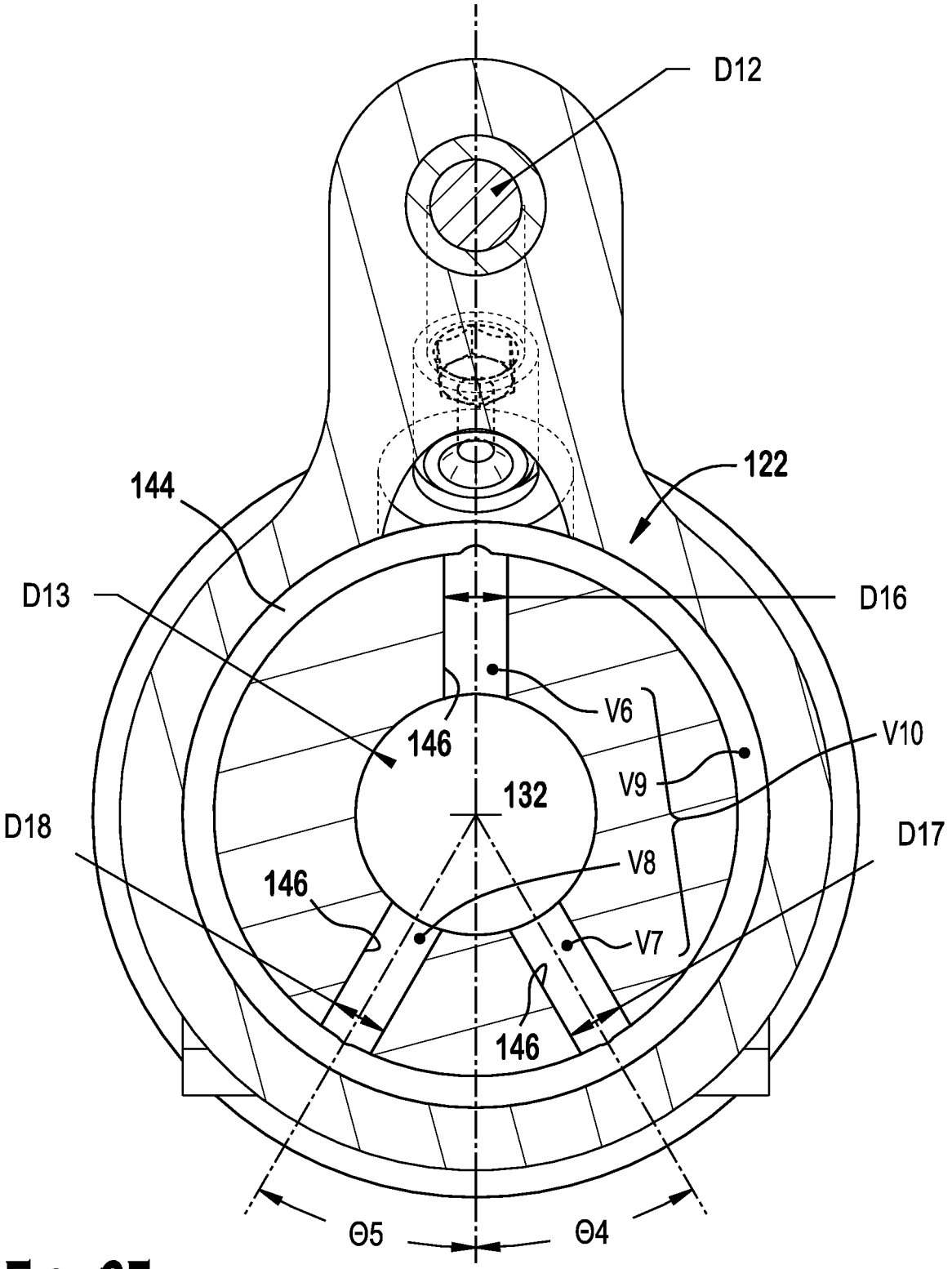
FIG. 25 is a cross-sectional view of the gas block and barrel interface of FIG. 24, along line 25-25.

Referring to FIG. 24 and FIG. 25, the radially cut ring shaped groove 144 may define a volume V9 when a gas block 24 is installed on the barrel. The volume V9 may be a design parameter which determines the amount of modulation to correctly modulate a particular firearm based on its caliber and configuration. The volume V9 may be adjusted by length, depth, or width depending on certain other configuration variables. For example, in the barrel of FIG. 21, the volume V9 may be approximately 0.00838 $in^3$. Exemplary values—in units of cubic inches—for the respective volumes of the components in the gas block and barrel assembly 40 of FIG. 25 are presented in Table 5 below.

TABLE 5

| Exemplary Barrel Ring Recess Volumes | | | | |
|---|---|---|---|---|
| V6 (inch^3) | V7 (inch^3) | V8 (inch^3) | V9 (inch^3) | V10 (inch^3) |
| .00093 | .00076 | .00076 | .00838 | .01083 |

Additionally, referring to FIG. 25, the gas ports 146 may be of smaller diameter than a typical gas port in a conventional barrel of a gas driven auto loading firearm that is chambered for the same ammunition cartridge. Multiple gas ports 146 connecting the bore 132 and the circumferential groove 144 may allow for lower temperature exhaust gases per gas port powering the cycle of operation. This may reduce wear of operating mechanism components, beneficially modulate the cycle of operation, and enable more controllable fire during fully automatic fire.

Generally, the barrel may range in length L12 from approximately 3 inches to approximately 20 inches, including, without limitation, barrel lengths of approximately 5.5 inches, 10.5 inches, 14.5 inches, 16 inches, and 18 inches. Although the barrel 120 of FIG. 21 may be a 5.375 inch length barrel that is chambered for 300 BLK and an AR-15 platform, the barrel 120 may be configured for use with other ammunition cartridges and in other long arms or handguns. The muzzle end 134 may abut a threaded portion 136 which is configured and dimensioned to receive a flash hider, muzzle booster, suppressor or the like.

Referring to FIG. 22, the barrel 120 may have an overall length L12 of approximately 5.375 inches. Additionally, the gas ring recess may be centered approximately 3.005 inches from the breech face.

Figure 23:
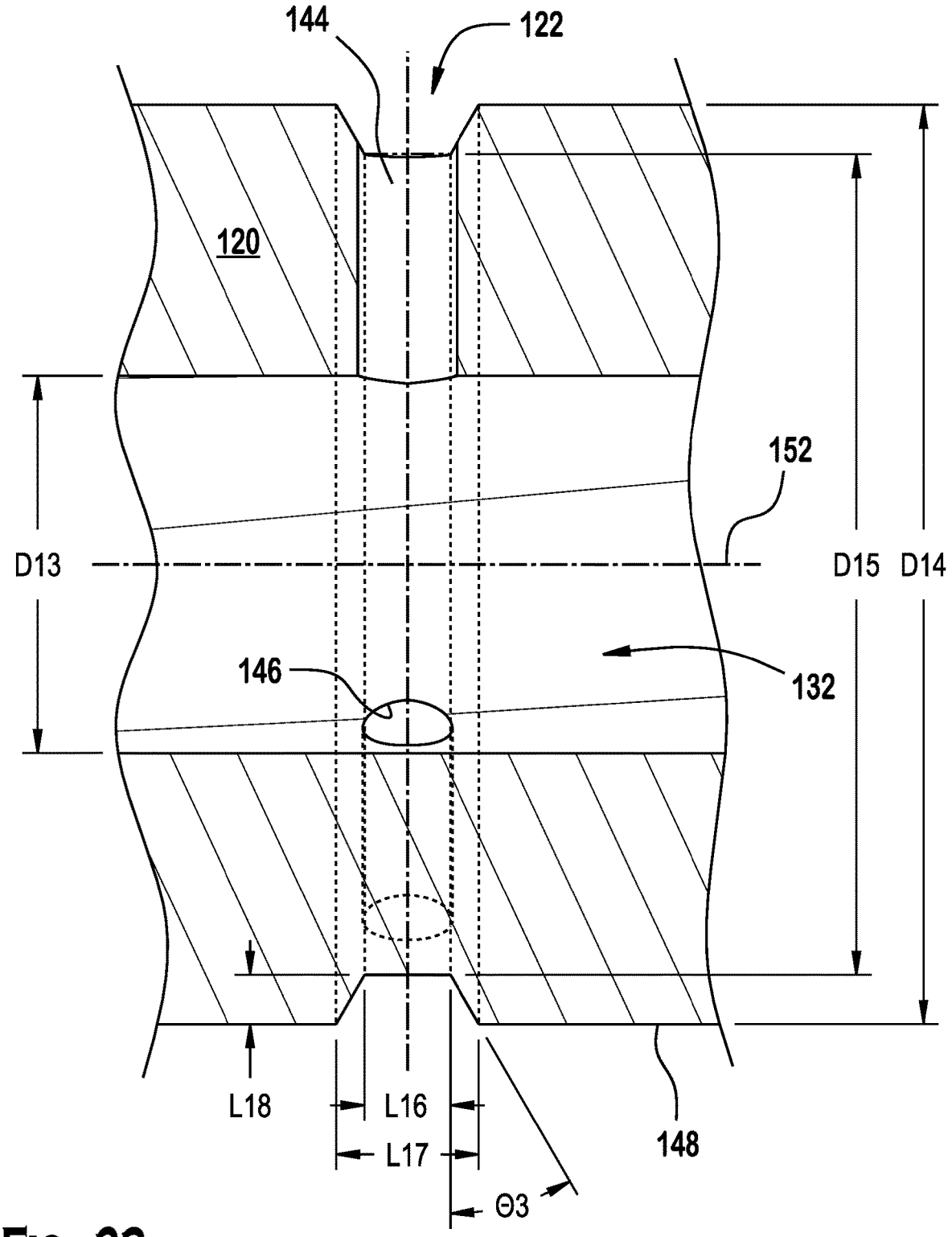
FIG. 23 is a detail view of the barrel and gas ring recess of FIG. 22.

Referring to FIG. 23, the width of the circumferential groove may range from L16 or approximately 0.70 inches to L17 or approximately 0.116 inches. Also, the side walls of the circumferential groove may be situated at an angle θ3 of approximately 30 degrees from normal. The bore D13 may be approximately 0.308 inches in diameter; whereas, the circumferential groove may possess an inner diameter D15 of approximately 0.670 inches and an outer diameter D14 of approximately 0.751 inches. In this embodiment, three gas ports 146 may connect the bore 132 and the circumferential groove 144. Referring to FIG. 25, one gas port may be aligned with a vertical axis and the other two gas ports may each be disposed at an angle θ4 and θ5, respectively, of approximately 30 degrees from the vertical axis. The vertically aligned gas port may have an inner diameter D16 of approximately 0.081 inches and the other two gas ports may have an inner diameter D17 and D18, respectively of approximately 0.073 inches. Generally, the number of gas ports 146 that exist radially about the barrel 120 of an autoloading firearm, as well as the dimensions of the circumferential groove 144 may possess a depth, width, and length which depends on the caliber and configuration of the host autoloading firearm.

Figures 26, 27:
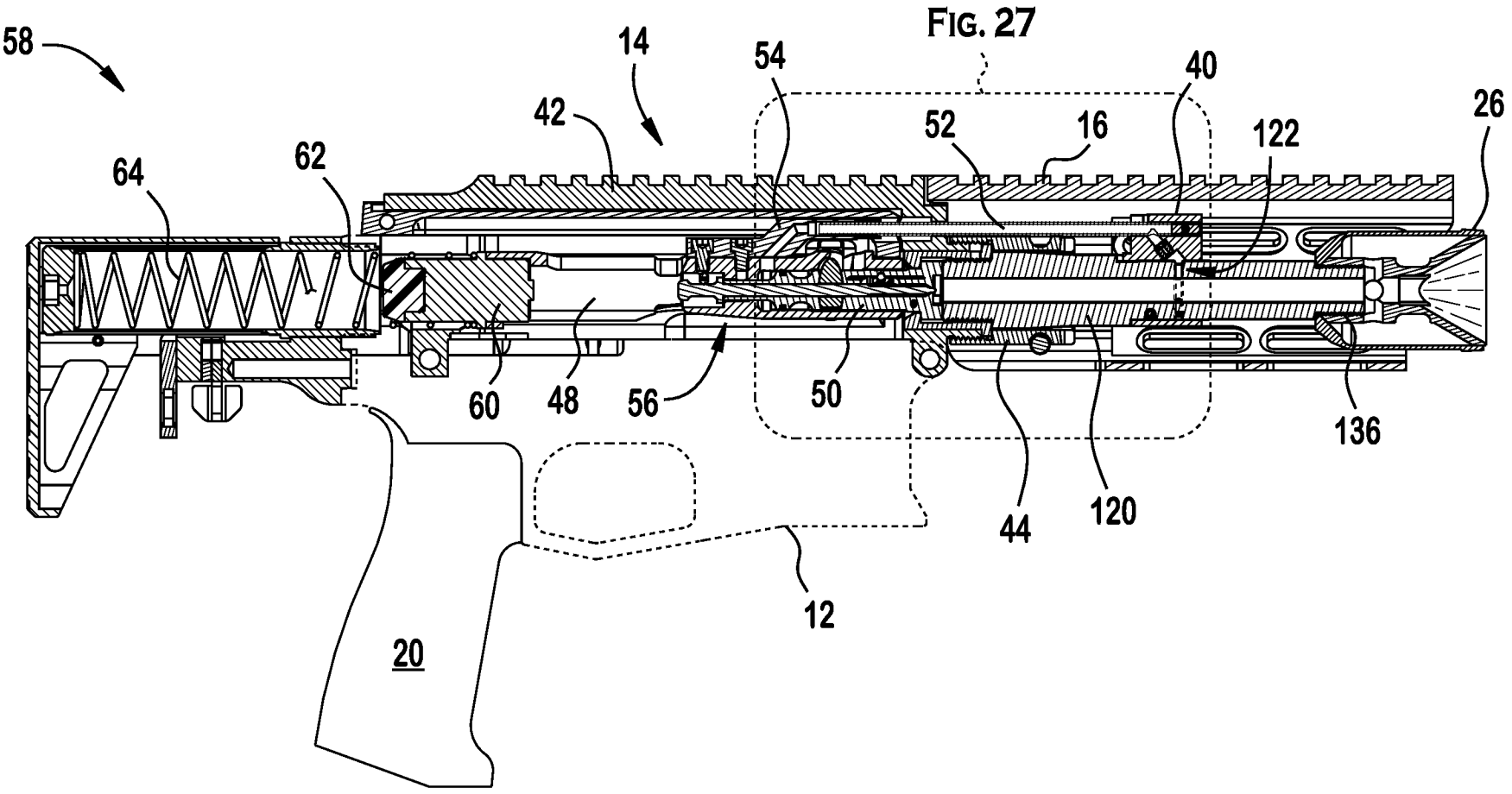
FIG. 26 is a cross-sectional view of part of the autoloading firearm of FIG. 1, along line 18-18 with the gas block and barrel interface of FIG. 24.
FIG. 27 is a detail view of the upper receiver group and regulated gas block assembly of FIG. 26.
Figure 27:
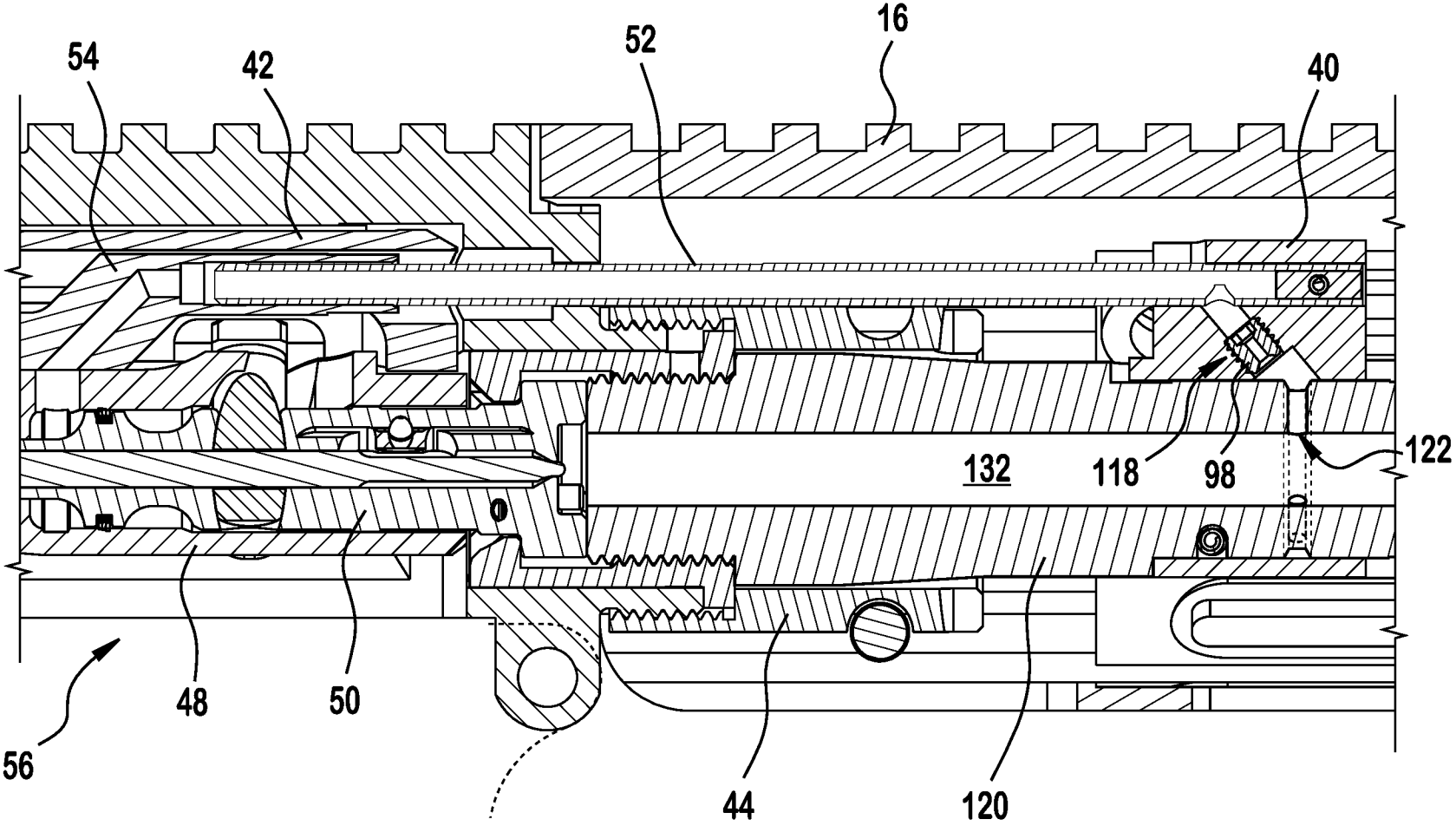

Referring to FIG. 26, the barrel 120 of FIG. 21 may be incorporated into a firearm. The firearm may be an autoloading firearm 10 and may include an upper receiver group 14, a lower receiver 12, a muzzle booster 26, a hand guard 16, a pistol grip 20 and a butt-stock 18. The upper receiver group 14 may include barrel 120 and regulated gas block assembly 40. The firearm may have a length of approximately 18.75 inches and weigh approximately 5 lbs. 11 oz. Referring to FIG. 20 and FIG. 24, the regulated gas block assembly 40 may be secured to the barrel 120. The regulated gas block assembly 40 may include a gas block 24, a gas tube 52, a gas tube pin, and a gas block pin.

As shown in FIG. 27, the upper receiver group 14 may include an upper receiver 42, a barrel nut 44, and a barrel 120. The barrel 120 may further include a bore 132. Additionally, the upper receiver group 14 may include a bolt carrier 48, a bolt 50, and a gas tube 52. The bolt carrier 48 may include a gas key 54. Moreover, the buffer system 58 may include a buffer body 60, a buffer body bumper 62, a buffer spring 64, and a buffer weight (not shown). Generally, the regulated gas block assembly 40, gas tube 52, gas key 54, and gas ring recess 122 may cooperate to selectively transfer discharge gases from the barrel 120 to the bolt carrier 48 to drive the bolt carrier group 56 toward the buffer body 60 and induce another cycle of operation.

Referring to FIGS. 21, 22 and 23 the bore 132 may have a central axis 152. The bore 132 may have a circular shape perpendicular to the central axis. For instance, the bore 132 may have a diameter ranging from approximately 0.17 inches to approximately 0.50 inches. In the exemplary embodiment, the bore has a diameter of approximately 0.308 inches.

Referring to FIGS. 20, 24 and 25, the regulated gas block assembly 40 may include a gas block 24. The gas block 24 may include a barrel receiving bore 72 which extends from one side of the gas block to another side of the gas block. The barrel receiving bore 72 may be configured and dimensioned to form a slip fit with the barrel 132. The gas block 24 further may include an orientation key 74 which mates with the barrel 120 to position the gas block on the barrel. The gas block 24 further may include a cross pin receiving hole 76 which cooperates with a similar hole in the barrel wall to fasten the gas block on the barrel.

The gas block 24 may further include a gas tube receiving bore 80. The gas tube receiving bore may be configured and dimensioned to receive the distal end of the gas tube 52. The gas tube receiving bore 80 may extend from the one side of the gas block 24 to the other side of the gas block 24. The gas tube receiving bore 80 may have a longitudinal axis 82. The gas tube receiving bore 80 may have a circular shape perpendicular to the longitudinal axis. For example, without limitation, the gas tube receiving bore 80 may have a diameter D5 ranging from approximately 0.08 inches to approximately 0.30 inches. In the exemplary embodiment, the gas tube receiving bore may have a diameter of approximately 0.181 inches. The longitudinal axis 82 of the gas tube receiving bore may be parallel to the central axis of the bore.

Referring to FIG. 24 and FIG. 27, the gas tube receiving bore 80 may include a screw thread on the sidewall of the gas tube receiving bore. Although the screw thread may start on the proximal side of the gas tube receiving bore and extend to the distal end of the gas tube receiving bore, the screw thread may define a threaded segment on the gas tube receiving bore sidewall that is shorter than the full length of the gas tube receiving bore sidewall as long as a secure and gas tight connection is established with the gas tube. Accordingly, the gas tube 52 may include a screw thread which mates with the screw thread on the gas tube receiving bore sidewall.

Moreover, the proximal side of the gas block 24 may include a flange. The flange may surround the circumference of the barrel receiving bore 72. The exterior surface of the flange may include a screw thread. The flange may be configured and dimensioned to seal discharge gases in the gas block, and thus may limit fugitive emissions which can adversely affect performance of the gas system. One or more fasteners may be operatively associated with the flange such that the one or more fasteners cooperate with the flange to achieve a secure and gas tight connection between the barrel and the proximal side of the gas tube receiving bore.

In use, a barrel with a gas ring which includes a number of gas ports in a barrel of a gas driven auto loading firearm, may allow for lower temperature exhaust gases per gas port powering the cycle of operation. This may reduce wear of operating mechanism components, beneficially modulate the cycle of operation, and enable more controllable fire during fully automatic fire. Also, the autoloading firearm may be able to fire subsonic ammunition or supersonic ammunition without adjustment of the gas operating system.

Figure 28:
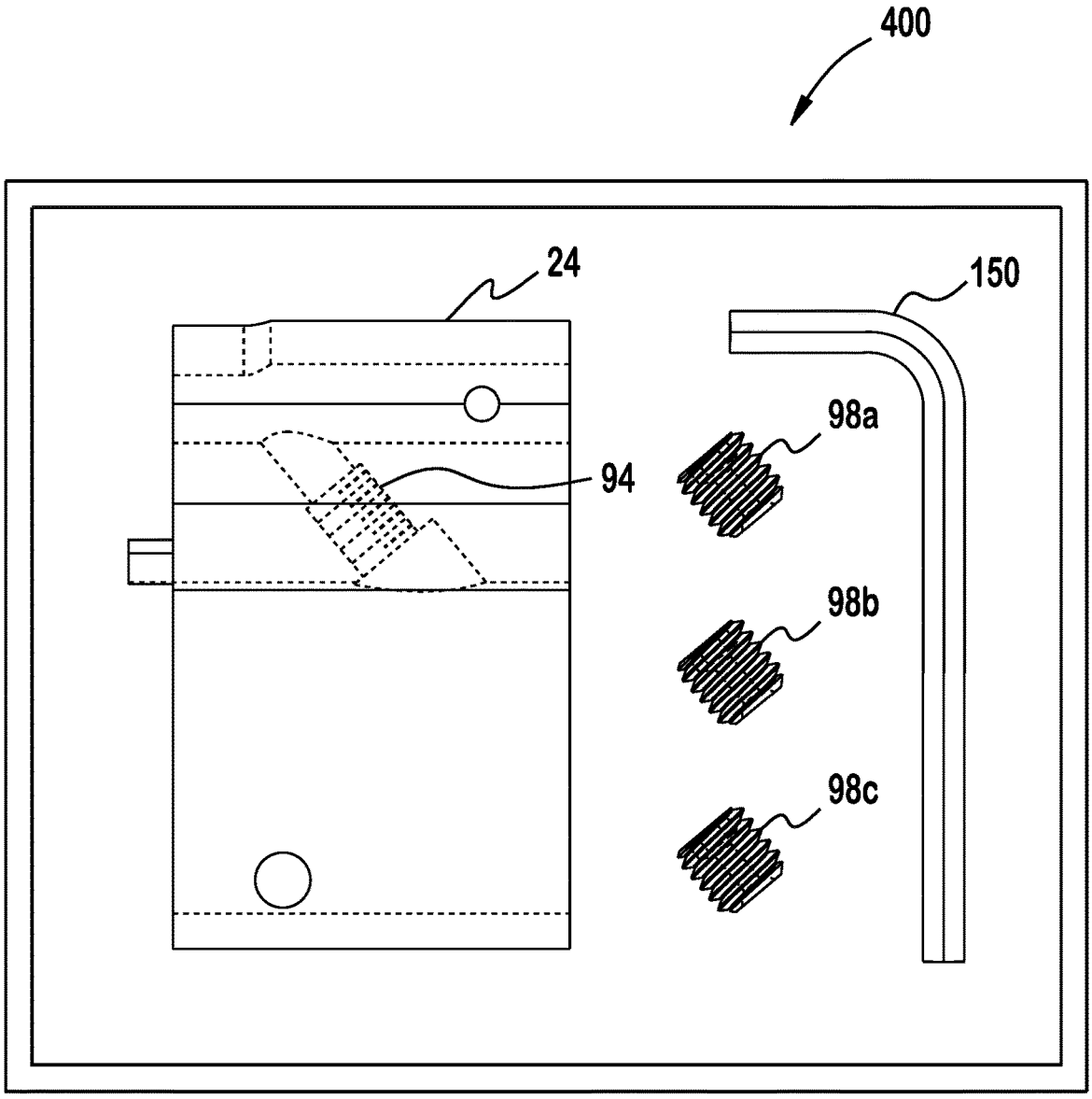
FIG. 28 shows a gas block kit in accordance with the present invention.

FIG. 28 depicts an exemplary gas block replacement kit 400 which may include a gas block 24 with a seat 94 for receiving a gas regulator 98, three gas regulators 98*a*, 98*b*, 98*c* for use with the gas block, and a drive tool 150 for installing or removing any one of the three gas regulators (98*a*, 98*b*, 98*c*) in the seat 94. The kit 400 may include instructions for effecting gas block replacement on a host firearm, as well as effecting gas regulator replacement following installation of the regulated gas block 40 on the host firearm.

The gas regulators (98*a*, 98*b*, 98*c*) in the kit 400 may be substantially the same, and further may be configured and dimensioned for use with a particular barrel. For example, each of the three gas regulators may be configured and dimensioned for use with a barrel chambered for 5.56 NATO ammunition cartridges and having a length of approximately 5.5 inches, 8.5 inches, or 10.3 inches. In another example, each of the three gas regulators may be configured and dimensioned for use with a barrel chambered for 7.62×39 mm ammunition cartridges and having a length of approximately 5.5 inches, 8.5 inches, or 10.3 inches. In yet another example, each of the three gas regulators may be configured and dimensioned for use with a barrel chambered for BLK 300 ammunition cartridges and having a length of approximately 5.5 inches, 8.5 inches, or 10.3 inches.

Moreover, each of the gas regulators may be configured and dimensioned for use with a different barrel. For example, each of the three gas regulators may be configured and dimensioned for use with a barrel chambered for 5.56 NATO ammunition cartridges and having a respective length of approximately 5.5 inches, 8.5 inches, or 10.3 inches. In another example, each of the three gas regulators may be configured and dimensioned for use with a barrel chambered for 7.62×39 mm ammunition cartridges and having a respective length of approximately 5.5 inches, 8.5 inches, or 10.3 inches. In yet another example, each of the three gas regulators may be configured and dimensioned for use with a barrel chambered for BLK 300 ammunition cartridges and having a respective length of approximately 5.5 inches, 8.5 inches, or 10.3 inches.

In yet another example, each of the three gas regulators may be configured and dimensioned for use respectively with a barrel chambered for 5.56 NATO ammunition cartridges, 7.62×39 mm ammunition cartridges, and BLK 300 ammunition cartridges. The respective barrels may each have substantially the same length, such as without limitation, a barrel length of approximately 5.5 inches, 8.5 inches, or 10.3 inches.

In yet another example, each of the three gas regulators may be configured and dimensioned for use respectively with a barrel chambered for a specific cartridge type but having different performance characteristics. For instance, the gas regulators may be configured and dimensioned for a 5.56 NATO ammunition cartridge, a 5.56 NATO ammunition cartridge having a maxim charge of propellant, and a 5.56 NATO ammunition cartridge having a subsonic charge of propellant, respectively. Accordingly, each of the three gas regulators may be configured and dimensioned for use in a particular operational mode of the firearm (e.g., unsuppressed, suppressed etc.).

Figure 29:
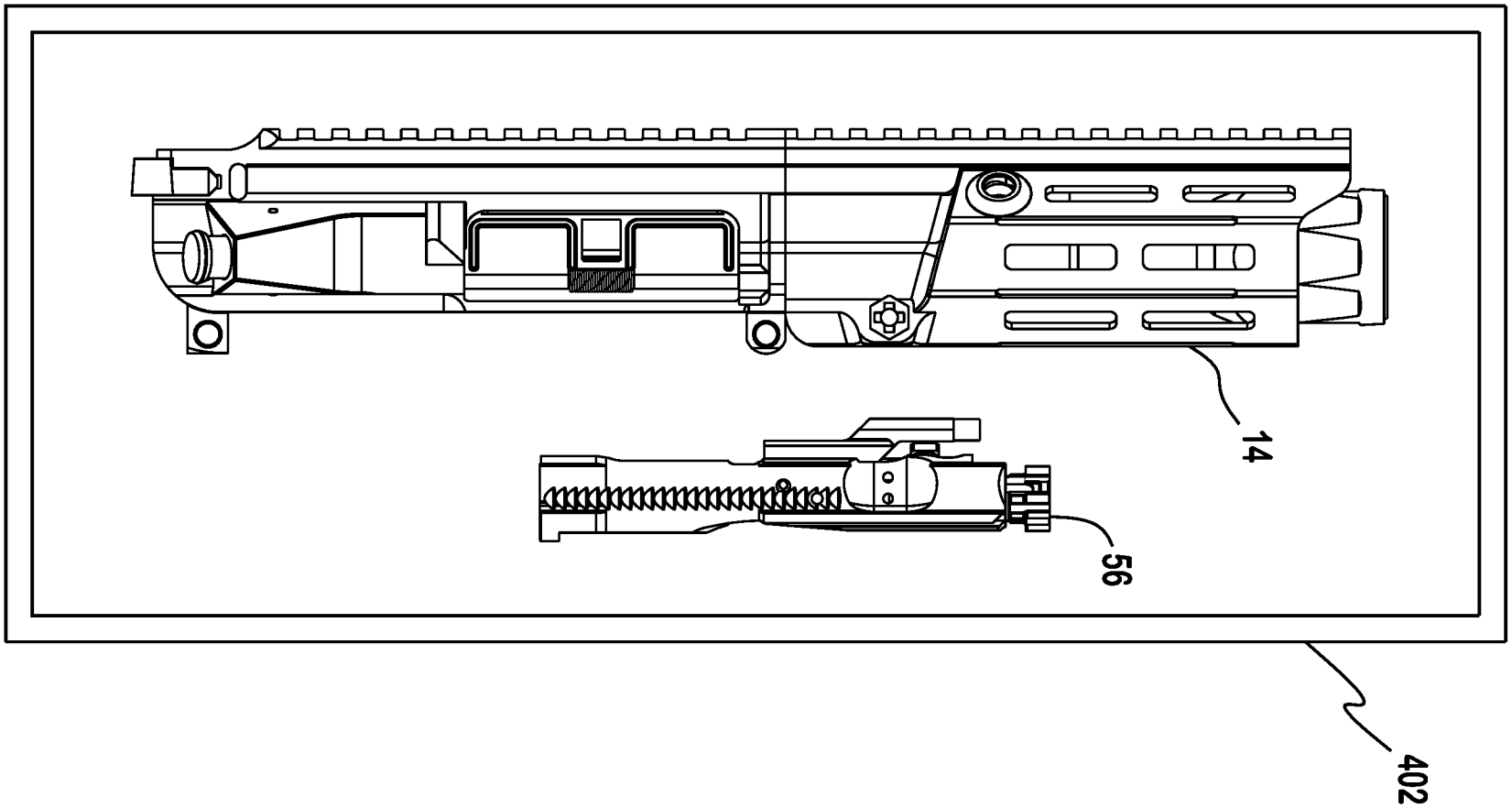
FIG. 29 shows an upper receiver group and bolt carrier group kit for a modular lower receiver.

FIG. 29 depicts an upper receiver group and bolt carrier group replacement kit 402 for use on a modular lower receiver. The upper receiver group 14 may include a regulated gas block assembly 40. For example, the upper receiver group may be the upper receiver group disclosed in FIG. 18. In another example, the upper receiver group may be the upper receiver group disclosed in FIG. 26. The upper receiver group, however, may include other regulated gas block assembly 40 and barrel 22 configurations. Generally, the upper receiver group may be installed directly on the completed lower receiver. For instance, the modular lower receiver may be a M4 Mil-Spec lower receiver. Similarly, the bolt carrier group may be a M4 Mil-Spec bolt carrier group. Alternatively, the bolt carrier group 56 may be a bolt carrier group that is configured and dimensioned for use with a different buffer system and butt-stock. The kit 402 may include instructions for effecting upper receiver group replacement on a host lower receiver, as well as effecting and bolt carrier group replacement following installation of the upper receiver group on the host lower receiver.

Figure 30:
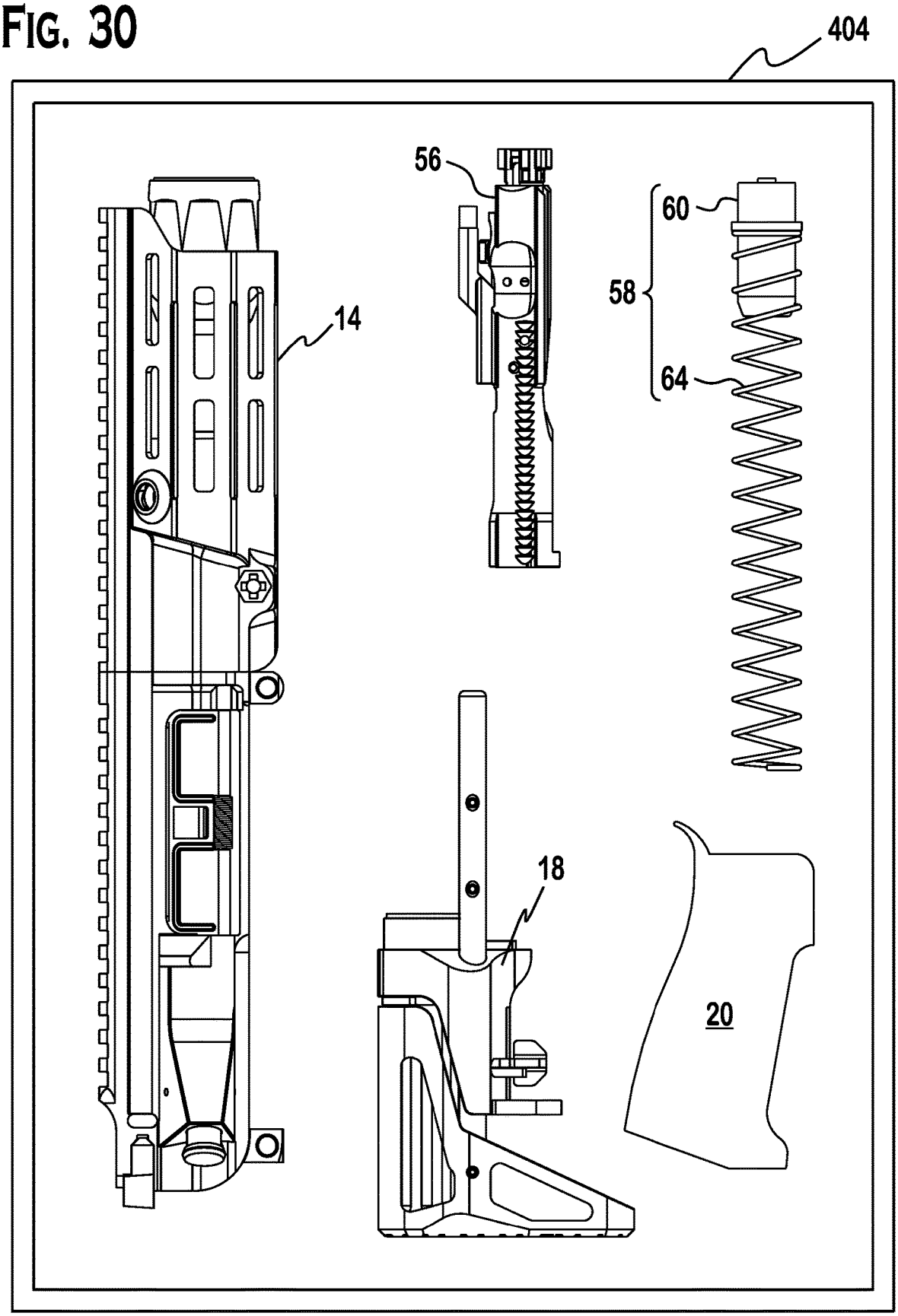
FIG. 30 shows an upper receiver group, bolt carrier group, buffer body, buffer spring, butt-stock and pistol grip kit for a modular lower receiver.

FIG. 30 depicts another upper receiver group and bolt carrier group replacement kit 404 for use on a modular lower receiver. The upper receiver group 14 may include a regulated gas block assembly 40. For example, the upper receiver group 14 may be the upper receiver group 14 disclosed in FIG. 18. In another example, the upper receiver group may be the upper receiver group disclosed in FIG. 26. The upper receiver group 14, however, may include other regulated gas block assembly 40 and barrel 22 configurations. Generally, the upper receiver group 14 may be installed directly on the completed lower receiver. For instance, the modular lower receiver may be a M4 Mil-Spec lower receiver. The kit 404 may further include an SCW bolt carrier group 56, SCW butt-stock 18, and associated buffer system 58. Further, the kit 404 may include a pistol grip 20 for the modular lower receiver. Also, the kit 404 may include instructions for effecting upper receiver group replacement and SCW butt-stock installation on a host lower receiver. The instructions further may include directions for installing the SCW bolt carrier group and associated buffer system following installation of the upper receiver group and SCW butt-stock on the host lower receiver.

While it has been illustrated and described what at present are considered to be preferred embodiments of the present invention, it will be understood by those skilled in the art that various changes and modifications may be made, and equivalents may be substituted for elements thereof without departing from the true scope of the invention. Moreover, features and/or elements from any disclosed embodiment may be used singly or in combination with other embodiments. Therefore, it is intended that this invention not be limited to the features disclosed herein, but that the invention include all embodiments falling within the scope and the spirit of the present invention.

What is claimed is:

1. A gas block assembly for regulating gas flow to an autoloading firearm operating system comprising:

a gas block for collecting discharge gases from a barrel which comprises a first side, a second side spaced from the first side, a barrel receiving bore extending from the first side to the second side, the barrel receiving bore including a first longitudinal axis;

a gas tube receiving bore extending from the first side to the second side, the gas tube receiving bore including a second longitudinal axis, the second longitudinal axis being in substantially parallel alignment with the first longitudinal axis; and an intermediate passage extending from the barrel receiving bore to the gas tube receiving bore, the intermediate passage including a third longitudinal axis, the third longitudinal axis and the first longitudinal axis defining a first angle, the first angle being greater than or equal to 30 degrees and less than or equal to 90 degrees, the intermediate passage comprising an exiting gas hole segment adjacent to the gas tube receiving bore, the exiting gas hole segment comprising a first cross-section perpendicular to the third longitudinal axis, the first cross-section comprising a first diameter, and a gas regulator seat adjacent to the exiting gas hole segment, the gas regulator seat comprising a second cross-section perpendicular to the third longitudinal axis, the second cross-section comprising a second diameter, the second diameter being greater than the first diameter; and a gas regulator arranged in the gas regulator seat, the gas regulator comprising a plug including a fourth longitudinal axis, the plug comprising a first end, a second end spaced from the first end along the fourth longitudinal axis, a gas regulating hole extending from the first end to the second end, the gas regulating hole comprising a nozzle segment facing the barrel receiving bore, a keyed segment facing the exiting gas hole segment, and an intermediate segment disposed between the nozzle segment and the keyed segment.

2. The gas block assembly of claim 1, wherein the plug further comprises an exterior surface between the first end and the second end, the gas regulator seat further comprises a first screw thread, and the exterior surface comprises a second screw thread, the second screw thread being configured and dimensioned to mate with the first screw thread.

3. The gas block assembly of claim 2, wherein the first screw thread and the second screw thread are interlocked, blocking fluid flow between the exterior surface and the gas regulator seat.

4. The gas block assembly of claim 3, wherein the keyed segment comprises a drive slot for rotating the gas regulator with respect to the gas regulator seat.

5. The gas block assembly of claim 4, wherein the drive slot comprises a third cross-section perpendicular to the fourth longitudinal axis, the third cross-section having hexagonal shape.

6. The gas block assembly of claim 4, wherein the first angle is a 50 degree angle.

7. The gas block assembly of claim 4, wherein the first angle is a 90 degree angle.

8. The gas block assembly of claim 1, wherein the gas block further comprises an access portal proximate to the gas tube receiving bore, the access portal providing access to the exiting gas hole such that a drive tool may be arranged through the access portal and the gas tube receiving bore and fitted into the keyed segment.

9. A regulated gas block and barrel assembly comprising:

a gas block assembly of claim 1, and a barrel fitted in the barrel receiving bore.

10. The regulated gas block and barrel assembly of claim 9, wherein the intermediate passage of the gas block assembly of claim 1 further comprises a starting gas hole segment adjacent to the barrel receiving bore, and the gas regulating hole of the gas block assembly of claim 1 fluidly connects the starting gas hole segment and the exiting gas hole segment.

11. The regulated gas block and barrel assembly of claim 10, wherein the intermediate segment of the gas block assembly of claim 1 further comprises a fourth cross-section perpendicular to the fourth longitudinal axis, the fourth cross-section comprising a first maximum outer dimension, and the starting gas hole segment comprises a fifth cross-section perpendicular to the third longitudinal axis, the fifth cross-section comprising a second maximum outer dimension, the second maximum outer dimension being greater than the first maximum outer dimension.

12. The regulated gas block and barrel assembly of claim 10, wherein the barrel further comprises a first gas port, and the first gas port is in fluid communication with the starting gas hole segment.

13. The regulated gas block and barrel assembly of claim 10, wherein the barrel further comprises a gas ring recess, and the gas ring recess is in fluid communication with the starting gas hole segment.

14. The regulated gas block and barrel assembly of claim 13, wherein the gas ring recess comprises a circumferential groove around the barrel.

15. The regulated gas block and barrel assembly of claim 14, wherein the barrel further comprises a plurality of gas ports, and the plurality of gas ports are in fluid communication with the circumferential groove.

16. The regulated gas block and barrel assembly of claim 9, wherein the barrel has a length, and the length has a range from approximately 3.5 inches to approximately 20 inches.

17. The regulated gas block and barrel assembly of claim 9, wherein the barrel is chambered for a 5.56 NATO ammunition cartridge, a 7.62 mm×39 mm ammunition cartridge, or a 300 BLK ammunition cartridge.

18. An upper receiver group replacement kit for a small arms weapon comprising:

a gas block assembly of claim 1;

a barrel; and a muzzle booster.

19. The upper receiver group replacement kit of claim 18 further comprising:

a bolt carrier group.

20. The upper receiver group replacement kit of claim 19 further comprising:

a buffer system; and a butt-stock.

* * * * *